US008485378B2

(12) United States Patent
Zoss et al.

(10) Patent No.: US 8,485,378 B2
(45) Date of Patent: Jul. 16, 2013

(54) MULTI-CONTAINER PACKAGES FOR DISPENSING LIQUID AND DRY FOOD

(75) Inventors: Robert A. Zoss, Plymouth, MN (US); Bryan Scholtes, Fridley, MN (US); Dan Genord, South Lyon, MN (US)

(73) Assignee: General Mills, Inc., Minneapolis, MN (US)

( * ) Notice: Subject to any disclaimer, the term of this patent is extended or adjusted under 35 U.S.C. 154(b) by 769 days.

(21) Appl. No.: 12/384,709

(22) Filed: Apr. 8, 2009

(65) Prior Publication Data

US 2010/0260901 A1 Oct. 14, 2010

(51) Int. Cl.
*B65D 21/02* (2006.01)

(52) U.S. Cl.
USPC ..... 220/23.86; 220/212; 220/503; 220/522; 215/DIG. 8; 206/219

(58) Field of Classification Search
USPC ..... 206/541, 219; 220/23.4, 23.83, 212, 220/521, 574, 575, 695, 697, 699–701, 705, 220/735, 736, 23.86, 503, 504, 522; 426/85, 426/120; 215/DIG. 8
See application file for complete search history.

(56) References Cited

U.S. PATENT DOCUMENTS

| | | | | | |
|---|---|---|---|---|---|
| 1,013,775 | A | * | 1/1912 | Hoffman | 232/1 R |
| 1,331,428 | A | * | 2/1920 | Glud | 220/87.1 |
| 1,665,289 | A | * | 4/1928 | Weaver | 229/400 |
| 1,977,227 | A | * | 10/1934 | Berendt | 222/490 |
| 2,695,614 | A | * | 11/1954 | Lockhart | 206/221 |
| 3,040,897 | A | * | 6/1962 | Holman | 210/244 |
| 3,139,180 | A | * | 6/1964 | Kobernick | 206/220 |
| 3,239,089 | A | * | 3/1966 | Donough | 206/221 |
| 3,410,444 | A | * | 11/1968 | Morane | 206/219 |
| 3,442,435 | A | * | 5/1969 | Huston et al. | 220/528 |
| 3,451,540 | A | * | 6/1969 | Kulischenko | 206/220 |
| 3,684,136 | A | * | 8/1972 | Baumann | 222/386 |
| 3,831,742 | A | * | 8/1974 | Gardella et al. | 206/219 |

(Continued)

FOREIGN PATENT DOCUMENTS

| | | |
|---|---|---|
| WO | WO 02/064494 | 8/2002 |
| WO | WO 02/066339 | 8/2002 |
| WO | WO 2007/002623 | 7/2007 |

OTHER PUBLICATIONS

Harriet Carter, "*Cereal-on-the-Go*," http://www.harrietcarter.com/index.cfm/fuseaction/product.detail/categoryID/C64C0157-E9A3-473A-A54B-8320E49D5237/productID/48C530B8-3BC1-4ACF-B37A-F136574422B8.

(Continued)

*Primary Examiner* — J. Gregory Pickett
*Assistant Examiner* — Ned A. Walker
(74) *Attorney, Agent, or Firm* — John L. Crimmins; Michaele A. Hakamaki; Daniel C. Schulte

(57) ABSTRACT

Food packages having features such as multiple containers in a single package and multiple pieces for a package, wherein the packages can contain multiple food products such as cereal and milk, but not necessarily cereal and milk, for consumption together in a convenient manner. One food package includes a lower container and an upper container, wherein the upper container includes an interior space that is defined by a three-dimensional bottom having at least one aperture, and sidewalls, with a reservoir formed in the three-dimensional bottom and including a volume at the bottom of the reservoir located below the at least one aperture.

11 Claims, 20 Drawing Sheets

U.S. PATENT DOCUMENTS 4,197,943 A * 4/1980 Weikel ..... 206/219
4,294,924 A * 10/1981 Pepicelli et al. ..... 435/30
4,402,911 A * 9/1983 Walters ..... 422/550
4,417,504 A * 11/1983 Yamamoto ..... 99/306
4,478,346 A * 10/1984 Spong ..... 220/711
4,515,267 A * 5/1985 Welsh ..... 206/219
4,522,308 A * 6/1985 Sullivan ..... 215/253
4,558,804 A 12/1985 Keck
D288,527 S * 3/1987 Maguire ..... D9/745
4,779,722 A * 10/1988 Hall ..... 206/221
4,842,157 A * 6/1989 Stone-Parker et al. ..... 220/719
4,863,017 A * 9/1989 Vlock ..... 206/219
4,979,630 A * 12/1990 Rose et al. ..... 215/47
4,995,519 A * 2/1991 Rose et al. ..... 215/47
5,085,330 A * 2/1992 Paulin ..... 215/6
5,168,140 A * 12/1992 Welker ..... 219/689
5,180,079 A * 1/1993 Jeng ..... 220/705
5,196,216 A * 3/1993 Lynch et al. ..... 426/112
5,312,014 A * 5/1994 Hamlin ..... 220/703
5,318,787 A * 6/1994 Brauner et al. ..... 426/120
5,328,041 A * 7/1994 Hook et al. ..... 215/247
5,328,051 A 7/1994 Potter et al.
5,361,918 A * 11/1994 Mason ..... 215/6
5,370,260 A * 12/1994 Paramski ..... 220/580
5,397,178 A * 3/1995 Konietzko ..... 366/197
5,402,907 A * 4/1995 Liu ..... 220/502
5,405,001 A * 4/1995 Lillard ..... 206/221
5,514,394 A * 5/1996 Lenahan ..... 426/120
5,573,131 A * 11/1996 Berjis ..... 220/4.03
5,588,561 A 12/1996 Ness
5,664,705 A * 9/1997 Stolper ..... 222/212
5,676,244 A 10/1997 Green et al.
5,676,275 A 10/1997 Khattar
5,706,980 A 1/1998 Dickerson
5,727,679 A 3/1998 Newarski
5,753,289 A 5/1998 Ness
5,782,345 A * 7/1998 Guasch et al. ..... 206/222
5,913,964 A * 6/1999 Melton ..... 99/322
5,971,202 A * 10/1999 Filbrun ..... 220/719
6,045,254 A * 4/2000 Inbar et al. ..... 366/130
6,080,132 A * 6/2000 Cole et al. ..... 604/85
6,089,389 A * 7/2000 Sharon et al. ..... 215/11.1
6,113,257 A * 9/2000 Sharon et al. ..... 366/130
6,135,307 A * 10/2000 Fahy ..... 220/574
6,196,406 B1 3/2001 Ennis
6,221,402 B1 4/2001 Itoh et al.
6,248,363 B1 6/2001 Patel et al.
6,254,907 B1 7/2001 Galomb
6,264,068 B1 * 7/2001 Ours et al. ..... 222/129
6,325,968 B1 * 12/2001 Fricker et al. ..... 422/28
6,338,417 B1 * 1/2002 Ferraro ..... 220/23.83
6,427,864 B1 * 8/2002 Asselin ..... 220/709
6,474,494 B1 * 11/2002 Miller ..... 220/379
6,527,110 B2 * 3/2003 Moscovitz ..... 206/222
6,528,105 B1 3/2003 Gerhart et al.
6,533,113 B2 * 3/2003 Moscovitz ..... 206/222
6,641,319 B2 * 11/2003 May ..... 401/132
6,641,854 B2 11/2003 Gerhart et al.
6,706,297 B1 * 3/2004 Toth et al. ..... 426/120
6,814,250 B1 * 11/2004 Madsen ..... 220/212
6,913,777 B2 7/2005 Rebhorn et al.
6,974,024 B2 * 12/2005 Cho ..... 206/219
6,994,211 B2 * 2/2006 Cho ..... 206/221
7,063,229 B2 6/2006 Westerhof et al.
7,111,748 B2 * 9/2006 Cha ..... 220/4.27
7,217,434 B1 * 5/2007 Loh et al. ..... 426/115
7,306,127 B2 * 12/2007 Eimer ..... 222/494
7,306,128 B2 * 12/2007 Eimer ..... 222/494
7,331,478 B2 * 2/2008 Aljadi ..... 215/11.4
7,341,754 B1 * 3/2008 Loh et al. ..... 426/115
7,487,881 B2 * 2/2009 Watzke et al. ..... 220/501
7,726,512 B2 * 6/2010 MacCarthy ..... 220/737
7,798,346 B2 * 9/2010 Nelson et al. ..... 215/6
7,815,073 B1 * 10/2010 Fairchild ..... 222/129
7,850,027 B2 * 12/2010 Hayes et al. ..... 215/11.4
7,866,183 B2 * 1/2011 Roth et al. ..... 62/457.3
7,976,234 B2 * 7/2011 May ..... 401/132
8,028,847 B2 * 10/2011 Klaver et al. ..... 215/6
8,141,741 B2 * 3/2012 Metzger et al. ..... 220/672
8,146,758 B1 * 4/2012 Peres ..... 215/6
2002/0035997 A1 * 3/2002 Shapira ..... 128/898
2002/0066677 A1 * 6/2002 Moscovitz ..... 206/219
2002/0066679 A1 * 6/2002 Moscovitz ..... 206/221
2002/0110622 A1 8/2002 Lloyd et al.
2004/0200845 A1 * 10/2004 Watzke et al. ..... 220/501
2004/0262323 A1 * 12/2004 Cha ..... 220/709
2005/0172832 A1 8/2005 Groenke
2006/0032873 A1 * 2/2006 Gerondale et al. ..... 222/570
2006/0086755 A1 4/2006 Roth et al.
2006/0086756 A1 4/2006 Roth et al.
2006/0108022 A1 5/2006 Carter et al.
2007/0108152 A1 * 5/2007 Horton et al. ..... 215/11.1
2007/0221513 A1 9/2007 Taylor-Sharp et al.
2008/0078200 A1 * 4/2008 Roth et al. ..... 62/457.4
2009/0212004 A1 * 8/2009 Metzger et al. ..... 215/382
2009/0311389 A1 12/2009 Zoss et al.
2010/0003379 A1 1/2010 Zoss et al.
2011/0049081 A1 * 3/2011 Bourguignon ..... 215/227

OTHER PUBLICATIONS

Skopis, *Combination Container Kits*, "Lets get it together".

* cited by examiner

MULTI-CONTAINER PACKAGES FOR DISPENSING LIQUID AND DRY FOOD

FIELD OF THE INVENTION

The invention relates to food packages having features such as multiple containers in a single package and multiple pieces for a package; the packages can contain multiple food products including cereal and milk, but not necessarily cereal, for consumption together in a convenient manner.

BACKGROUND

Breakfast is considered the most important meal of the day, but traditional "at home" breakfast eating occasions are declining. Mornings are rushed so consumers need on-the-go (e.g., portable) breakfast product solutions. A significant reason for skipping breakfast is not having the time to eat at home. A portable breakfast allows a person to take a serving of breakfast along, away from the home, and eat the breakfast at their morning destination or on the way to that destination.

One of the most common breakfast foods is dry cereal eaten with milk. By conventional methods, a dry cereal is placed in a bowl or other container and milk is poured over the cereal. The consumer consumes the milk and cereal together from the bowl using a spoon. This conventional mode of cereal consumption requires the user to remain stationary to consume the cereal from the bowl and is not an activity that can be safely performed while the consumer is mobile, such as by walking, riding, or driving a vehicle. Also, the serving of cereal is not portable for consumption upon arrival at a destination. Understood limitations of this basic mode of consuming cereal are that the combination of the bowl of cereal and milk is not mobile, and, therefore, the consumer must place the cereal and milk into the bowl in one location (normally a kitchen or eating area), and to also eat the cereal using a spoon in that same location.

To make breakfast a more convenient meal, manufacturers have offered breakfast bars, breakfast sandwiches, and other breakfast foods that can be consumed with a single hand and without preventing the person eating the food from moving from the location at which the food was prepared or purchased. There have also been attempts to construct a container that stores cereal and milk separately and allows the cereal and milk to be removed from a storage location (e.g., kitchen) or place of purchase, to be consumed at a later time or different location. Some of these containers are designed to allow the consumer to eat cereal and milk from a container using a single hand, optionally without having to be at a stationary position, but optionally while moving with the container while consuming the contents. These containers may provide mobility to the cereal eater, but past package designs have suffered from various shortcomings. For instance, past designs may not allow for dispensing a desired amount of milk relative to cereal, may not allow for controlled delivery of cereal, or may allow cereal and milk to contact each other and become soggy.

Various products have been developed to contain cereal and milk separately and then allow the cereal and milk to be mixed when consumed using a container that can be manipulated by one hand. Examples of such product configurations are illustrated and described at U.S. Pat. Nos. 5,588,561, 5,753,289, 6,528,105, and others. Such products show a single container that may hold cereal and milk in separate compartments of a single container, in a manner to allow the cereal and milk to be dispensed from the single container.

Continuing need exists for a cereal container that can contain milk and cereal together in a single package that allows a user to dispense cereal and milk using one hand.

SUMMARY

The following description relates to food packages and containers that can be useful to hold a food (e.g., dry cereal) and a liquid (e.g., milk), in separate containers, and to dispense the particulate food and liquid as a combined mixture. Packages having multiple containers that can contain cereal and milk are also described in Applicant's copending U.S. Provisional Patent Application Ser. No. 61/131,508, filed Jun. 10, 2008, titled PACKAGES FOR DISPENSING LIQUID AND DRY FOOD, the entirety of which is incorporated herein by reference. Packages specifically described and illustrated herein include features also described in that copending application, and additionally describe added features.

While the description exemplifies milk and dry cereal as being contained in and dispensed from described packages, other forms of food will also be useful with packages as described. Certain package designs allow for a particulate food and the liquid to be stored, transported, and optionally sold or delivered, together, then consumed being dispensed from or removed from the package as a mixture. The packages are particularly useful for storing and allowing consumption of breakfast in the form of dry ("ready-to-eat") breakfast cereal, with milk.

The following description includes designs for packages and containers for separately storing foods including milk and cereal. Embodiments of packages allow the user to store or transport milk and cereal together and, at their convenience, combine the two for consumption. Certain package designs fit into consumers' busy lifestyles by enabling a consumer to eat their favorite cereals and milk while on the go, or to transport a single serving of cereal and milk to a location away from a point of purchase or storage (e.g., kitchen). Embodiments of product designs allow for cereal consumption with little to no preparation, primarily requiring the consumer to grab a combined cereal and milk package, and go; according to different embodiments a consumer may eat upon arriving at their destination or along the way. Certain embodiments provide better performance relative to past designs for packages that include cereal and milk.

Exemplary described packages allow a consumer to eat a mixture of cereal and milk with just a single hand, while in motion. Exemplary products can either be a complete offering supplying cereal and shelf stable milk, or may in the form of a package that contains cereal and no milk, but permits the user to supply their own serving of milk. For example, because the packages can contain cereal and milk separately, a package that contains cereal can be prepared, stored, shipped, and sold separately from a package that contains milk; the package that contains cereal can be combined with a separate milk product at any point of storage, preparation, shipping, inventorying, or commercial or retail sale, such as by a consumer who has purchased a cereal product and a milk product separately. In either approach the milk and cereal remain separate until the consumer is ready to consume the cereal and milk together.

Any of the packages and containers described, in combination with any one or more other features, can include specific features such as a "dose" control feature, a "sieve" feature, a "reservoir" feature, or features that involve two or more (multiple) pieces assembled to produce a multi-container package. Individual "pieces" can be produced by injection molding, thermoforming, or other methods, and may include one or more of a "cover" piece, a "container" piece (e.g., a "cereal container" piece), and a "lower container" piece. Pieces can be completely separate, or partially separate or separable, such as by being connected at a hinge. Other packages can involve the same features but a multi-piece construction or with construction as fewer pieces, e.g., a "cover piece" can be combined with a "container" piece or an "upper container" piece.

Various versions of multi-piece packages ("dose" control-type or "sieve" type packages, see below) can include a "cover piece" that is not merely flat but that is three-dimensional. Advantageously, a three-dimensional cover can improve the ease with which a consumer can dispense cereal and milk from a package.

A "dose" control feature can be a feature that controls amounts of cereal and milk that dispense from a package when tipped. This feature can involve structural features such as a holding stage, a milk channel, venting, or combinations of these.

A "sieve" feature can be a feature that allows passage of liquid between an interior space of a package that contains cereal and a space below the interior package.

Any of the described packages, such as those that include a "dose" control feature or those that include a "sieve" feature, can also involve a "reservoir," which is a volume within an interior space of a container (e.g., an "upper container") below apertures that allow for venting or fluid flow. As used herein, "below" an aperture means, when the package is held vertically, the aperture is located at a location of an interior space that is higher than the reservoir, to allow the reservoir to function to collect or retain fluid in the upper container when the package is held vertically. A reservoir may involve a three-dimensional bottom, but may also involve placement of a venting aperture at a location other than a bottom, such as at a stack or at a sidewall.

During use, milk is placed in the upper container by tipping a package. When un-tipped back to vertical an amount of milk not dispensed to a user will fall to the bottom of the upper container and drain back into a lower container. A reservoir in the upper container can retain a small amount of milk in the upper container interior space for use in consuming cereal from the upper container. For example, after most milk and cereal are used a small amount of cereal may remain on sides of the upper container (e.g., "sticking" to the sides by a small amount of milk), or at a bottom. Milk retained in the reservoir may be used collect the small remaining pieces of cereal by swirling the milk around the interior surfaces of the upper container interior space to collect the pieces sticking to interior surfaces or the bottom. Once collected the pieces of cereal and milk can be dispensed through the cover opening.

In one aspect the invention relates to multi-container package that includes: a lower container comprising that includes a lower container interior space defined by a bottom and sidewalls, and an opening in communication with the lower container interior space, at an upper region of the lower container; an upper container connected to the lower container, located above the lower container, the upper container including an upper container interior space defined by a three-dimensional bottom and sidewalls, the three-dimensional bottom extending between the sidewalls at a lower region of the sidewalls, the upper container interior space being in fluid communication with the lower container interior space, and a reservoir formed in the three-dimensional bottom, the reservoir comprising a volume at the bottom of the reservoir located below the aperture. The package can optionally be made of multiple separate pieces.

In another aspect the invention relates to a multi-container package that includes: a lower container including a lower container interior space defined by a bottom and sidewalls, and an opening in communication with the lower container interior space, at an upper region of the lower container; an upper container connected to the lower container, located above the lower container, the upper container including an upper container interior space defined by a bottom and sidewalls, the bottom extending between the sidewalls at a lower region of the sidewalls, the upper container interior space being in fluid communication with the lower container interior space, and the upper container including a cover extending between locations of a cover perimeter connected to the upper container sidewalls, the cover having a three-dimensional form that defines a coverspace below the cover and above the upper container interior space, wherein the upper container includes a holding stage defined at a bottom by a stage and at sides by sidewalls, including a front sidewall and a backwall, in fluid communication with the lower container interior space through a milk channel, and in fluid communication with the upper container interior space through a passage defined at least in part the backwall and the cover, the passage having a height dimension of at least 0.5 centimeters.

In another aspect the invention relates to a multi-container package that includes multiple pieces including: a lower container piece including a lower container volume defined by a bottom and sidewalls, the bottom extending between the sidewalls at a lower region of the sidewalls, an opening at an upper region of the lower container, and a lower container upper-container engagement at an upper region of the lower container; an upper container piece including an upper container volume defined by a bottom and sidewalls, the bottom extending between the sidewalls at a lower region of the sidewalls, an opening at an upper region of the sidewalls, an upper container lower-container-engagement that engages the lower container upper-container engagement in a liquid-tight manner, and an upper container upper engagement; the upper container interior space being in fluid communication with the lower container interior space; and a cover piece including a cover extending between locations of a cover perimeter, a cover piece engagement that engages the upper container upper engagement in a liquid-tight manner, the cover having a three-dimensional form that defines a coverspace below the cover and above the upper container interior space.

In another aspect the invention relates to a package including: an interior space defined by a three-dimensional bottom, a cover comprising a cover opening, and sidewalls, the three-dimensional bottom extending between the sidewalls at a lower region of the sidewalls; an aperture at a lower region of the interior space; and a reservoir formed in the three-dimensional bottom, the reservoir comprising a volume at the bottom of the reservoir located below the aperture, the reservoir having a volume in the range from 3 to 30 cubic centimeters.

In yet another aspect the invention relates to a package that includes: an interior space defined by a bottom, a cover comprising a cover opening, and sidewalls, the bottom extending between the sidewalls at a lower region of the sidewalls, an aperture formed in the bottom, and a liquid-tight engagement element, the engagement element comprising a snap-fit engagement element selected from the group consisting of: a detent, a shoulder, a beveled shoulder; a rounded ridge, a groove, a concave groove, and combinations of these.

In another aspect the invention relates to a package that includes: an interior space defined by a bottom and sidewalls, the bottom extending between the sidewalls at a lower region of the sidewalls, the bottom comprising an aperture; a cover; a holding stage defined in part by a stage and sidewalls, including a front sidewall and a backwall; and a milk channel located below the holding stage; wherein the holding stage is in fluid communication with the milk channel, and is in fluid communication with the upper container interior space through a passage between the backwall and the cover, the passage having a height dimension of at least 0.5 centimeters.

In further aspects the invention relates to methods of dispensing milk and cereal by use of packages described herein. The methods can generally include providing a package as described, wherein an upper container contains cereal and a lower container contains milk, and tipping the container to cause milk and cereal to dispense from the cover opening. Optionally milk flows from a lower container interior space, through a milk channel in the upper container, and through a cover opening. Alternately milk flows from a lower container interior space, through an upper container interior space, and through a cover opening. Optionally upon tipping, cereal flows from an upper container interior space and through a cover opening. Optionally upon tipping and, as desired, returning a package to vertical, cereal flows from an upper container interior space, through a cereal passage, through a cereal holding stage, and through a cover opening, optionally forming a cereal bridge at the cereal passage. Also optionally, upon tipping and returning an upper container to vertical, milk can remain in a reservoir located at an upper container interior space.

DETAILED DESCRIPTION

Figure 1C:
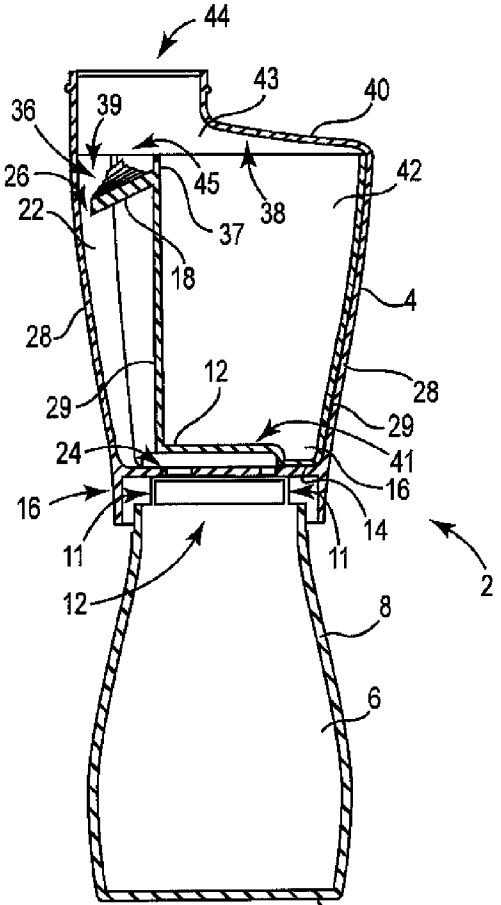
FIG. 1C is a side cut-away view of a package as described, taken along line A-A of FIG. 1B.

Following are descriptions and sketches of exemplary designs of packages for storing, dispensing, or storing and dispensing dry cereal and milk for consumption.

Embodiment of packages as described include separate containers for separately containing milk and cereal or other combinations of foods. The packages can allow a consumer to dispense the foods, e.g., milk and cereal, together as a mixed stream through a single opening directly into the consumer's mouth.

The cereal and milk are stored separately in two containers of the package, an "upper" container (sometimes otherwise simply referred to as a "container" or as a "cereal" container) that is above a "lower" container, and a lower container that is below the upper container.

Certain embodiments of packages involve a "dose" control and a cereal holding stage. Upon tipping the package to dispense the cereal and milk, dry cereal enters a cereal holding stage that is within the package, milk passes through a milk channel and also enters the cereal holding stage to contact the cereal, the milk and cereal contact and mix within the cereal holding stage, and the cereal and milk (after coming into contact with each other within the package) are delivered from the package to the consumer. As used herein, the terms "above" and "below" are used in a conventional manner to indicate a location of one feature of a package (above or below, i.e., higher than or lower than) relative to another feature, when the package is held vertically, unless otherwise indicated.

In general, a package can include a lower container for milk and a separate upper container for dry cereal. Use of the package is simple and intuitive. In embodiments where the two containers are sold together and engaged, the lower container is disengaged from its attachment at the bottom of the upper container. Optionally either milk is added to the lower container (if the package is sold without milk contained in the lower container) or if milk is already contained in the lower container a seal such as a foil (present to cover and seal the milk in the lower container) may be removed from the top opening of the lower container. In embodiments where the two containers are sold as separate products—a milk product and a cereal product—the milk product, including the lower container, can be opened and attached to the bottom of the cereal product, which contains the upper container. The lower container can be connected or re-connected to the bottom of the upper container. The engagement between the lower container and the upper container may be any liquid-tight engagement. Examples include threaded configurations, inter-locking or snap-fit surfaces such as a lip, flange, etc., at opposing engagement surfaces of the lower container and the upper container, or similar mechanical liquid-tight engagements.

In certain embodiments, the upper container can be opened by peeling a tab, unscrewing a cap, or opening a seal, etc., to allow access to an interior space such as a cereal holding stage, which in turn accesses locations of milk and dry cereal. The product can be used to deliver cereal and milk in the same manner as a beverage dispenser (e.g., a can or bottle such as used for carbonated beverages) by dispensing a mixture of cereal and milk by tipping the container to cause the contents to empty from the top of the container into a user's mouth. (As used herein, a package is considered to be tipped "forward" by tipping a front side of a top of the package in a direction toward the user, with the front side being a side of the package that dispenses cereal and milk and that is generally held toward the user.) According to embodiments of the described packages, a combined mixture of dry cereal and milk, in desired amounts or combinations of amounts, can be delivered directly to a user's mouth.

An optional feature of any of the described package embodiments may be the capability to deliver milk as a continuous and constant stream at a desired, pre-determined average flowrate, through a restricted opening. The amount of milk delivered can be controlled by the amount of time that the user holds the package in the tipped position, to allow a steady stream of milk to be delivered.

Milk will flow continuously through a milk channel extending from the lower container and through the upper container but not in contact with the dry cereal while in the milk channel. A "milk channel" is a continuous path extending from the lower container interior space to a location at an upper region of the upper container, optionally at a front location at the upper container, optionally to a milk port (e.g., an aperture or other opening that accesses the milk channel) at a holding stage. Milk can flow from the lower container, through the milk channel, to the milk port, when the package is tipped toward the user. The milk is continuously delivered from a milk port located in the upper container for as long as the package is in the tipped position. A continuous flow is achieved by equalizing pressure within the lower (milk) container as milk exits the lower container. Pressure equalization can be accomplished, e.g., by venting the lower container directly (by an aperture in the lower container) or through the upper container. The flow rate of the continuous flow can be controlled by selecting factors including the size of the opening (milk port) through which milk is delivered at the top of the upper container, the size of the milk channel, and the size of the vent.

According to exemplary embodiments of described packages that include a "holding stage" feature, an amount, rate, or amount and rate at which dry cereal is delivered from a package can optionally be affected or controlled to result in a desired volume ("dose") of cereal delivered each time the package is tipped. A "holding stage" is a space located at an upper container, optionally near a cover opening, optionally and preferably at a mid region or at an upper region of an upper container, most preferably at an upper region, such as at an upper half or upper third (by vertical height when the package is held vertically) of the upper container; alternately a holding stage can be at a location that is lower, such as at a middle region of the upper container between a top and a bottom. A holding stage can be defined at least partially by a "stage" or "shelf" at a bottom of the holding stage, and sidewalls. The holding stage sidewalls can include a front sidewall and a backwall, the backwall separating the holding stage (to the front of the backwall) and the upper container interior space (to the rear of the backwall). The top of the holding stage can be directly accessible to a "coverspace" or to a cover opening so that when the package is tipped toward the user an amount of cereal present in the holding stage can flow out of the cover opening. According to exemplary embodiments a cereal passage can be include a channel or opening between a cereal stage backwall and a cover, e.g., above an upper surface of a backwall and below a cover, optionally including space within a coverspace.

Control of the amount or rate of cereal delivery through the cover opening may be affected by factors generally including the size (volume) of a cereal holding stage near the cover opening, the size of a cereal passage through which cereal passes from the upper container interior space into the cereal holding stage, sizes of cereal pieces, and whether or not a cereal bridge forms at a cereal passage during flow of cereal when the package is tipped and held in a tipped orientation. The cereal holding stage can be a feature of the upper container, e.g., located at an upper region of the upper container, near the top of the upper container, near the upper container interior space and in communication with the upper container interior space, near the cover opening and also at the top of (above) the milk channel, optionally and preferably at or near the "front" of the package.

In certain embodiments a package can be designed to deliver approximately the same amount or "dose" of cereal each time a user tips the package to deliver cereal and milk; when the package is tipped, an amount of cereal becomes delivered from the upper container interior space, through a cereal passage, to the cereal holding stage (i.e., becomes pre-staged), and this amount of cereal becomes the next to be delivered the next time the package is tipped; optionally, cereal delivery stops or is interrupted upon formation of a cereal bridge, which is an amount of cereal that clogs the cereal passage to create a stoppage of cereal flowing through the cereal passage.

The amount, rate, or amount and rate of cereal delivery can also be affected by the size and density of the dry cereal pieces. The size of cereal pieces can be selected to cause a desired flow or flow rate through passages for delivery. The size of cereal pieces may also be selected to create a cereal "bridge" to interrupt cereal flow even while the package remains tipped. For example, a package can be designed to result in the formation of a cereal bridge to stop cereal flow through the cereal passage after a desired amount (one "dose") of cereal is dispensed. A cereal bridge may form during dispensing of the cereal when the package is tipped, at a cereal passage or at another opening through which cereal pieces flow. The size of a cereal passage or other opening that results in formation of a cereal bridge depends on the size of cereal particulates (pieces). Larger cereal particulates require a larger opening to allow a desired dose delivery followed by formation of a cereal bridge. An opening size may be selected to allow a desired or predetermined volume of cereal that is approximately one heaping teaspoon (alternately, a volume equal to the volume of the cereal holding stage) to be dispensed to the user with each tip of the package, then for a cereal bridge to form and stop the flow of cereal.

Exemplary width and height dimensions of a cereal passage can be sufficient to allow passage of a desired type of cereal such as a flake, a puffed cereal piece, etc., which may be relatively round (Trix™), square (Cinnamon Toast Crunch™), puffed and circular, (Cheerios™), etc. An example of a range of height dimensions of a cereal passage, defined as the distance from a top of a holding stage backwall to a closest location of a cover, can be from 5 millimeters to 25 millimeters, e.g., from 12 to 23 millimeters. An example of a range of width dimensions of a cereal passage, defined as a distance along a top of a holding stage backwall (which may be straight or arcuate), can be from 10 to 35 millimeters, e.g. from 15 to 30 millimeters.

A container that includes an interior space designed to contain cereal (often referred to herein as the "upper container") can be designed to engage another container, e.g., a "lower" container, at a lower region of the upper container, in a liquid-tight manner. The liquid-tight engagement can allow the upper container to be placed above the lower container in a manner for the upper container to be in fluid communication with the lower container (e.g., a lower container interior space) through one or multiple apertures, and for the combination of engaged containers to deliver milk and cereal through a single cover opening at an upper region of the package.

Such an engagement element may be any useful mechanical or adhesive-type engagement element the engages a corresponding element of the lower container. An engagement element can be located generally on a surface that extends around a perimeter of surface of the container, which may be an external surface or an internal surface. An exemplary engagements can include threads that allow a threaded engagement between two containers. Other exemplary engagements may involve one or more snap-fit mechanisms such as one or more of: a mechanical detent, a shoulder, a beveled shoulder having a variable (beveled) diameter increasing toward a bottom or top of a package or container piece to allow an opposing structure to snap-fit onto the beveled shoulder; a generally planar rounded ridge, groove, concave groove, ring, or annular ring; combinations of any of these; or any other type of molded or snap-fit structure that can be used to produce a liquid-tight engagement.

Certain embodiments as described include a "holding stage" and related features designed to deliver a desired amount of cereal (e.g., a "dose") and a steady flow of milk. An overall design of a dosing mechanism for delivery of a desired predetermined amount of cereal, optionally interrupted by formation of a cereal bridge, can be based on features that include selection of the size of the opening of a cereal passage leading from an upper container interior space to a cereal holding stage, a size of a holding stage, and the size, shape, and density of cereal pieces. The mechanism is based on the tendency of particulates (cereal pieces) to bridge across an opening if their size is smaller than the opening, but still large in relation to the opening, and if the flow rate is sufficiently rapid. Formation of a cereal bridge can be used in the present application as a cereal delivery control mechanism in this package design. The control mechanism can be made to occur when an average diameter of cereal pieces is from about 25 to about 95, e.g., from about 75 to 95 percent of a dimension (e.g., a height dimension) of an opening; if the opening is not square or round the relevant dimension is the smallest dimension of the opening.

According to various embodiments, a volume of cereal that can be delivered as a single "dose" from a package, based on a user tipping the package a single time, can be in the range of about 0.25 to 4 cubic inches. This can be accomplished by package features that include a holding stage, cover opening, and cereal passage, dimensioned to accommodate this dosage. An exemplary volume of a holding stage can be in a range of 0.25 to 3 cubic inches; an exemplary area dimension of a cereal passage can be in a range of 0.5 to 2 square inches; and an exemplary dimension of a cover opening can be in a range of 0.5 to 2 square inches, optionally round or generally round with a diameter of from to 0.7 to 1.2 inches.

Related to the volume of a holding stage is a cross sectional area of a holding stage, meaning for example dimensions of a "stage" defining a lower surface of a holding stage, or a parallel cross section of above the stage. The vertical dimension (height, from top to bottom) may matter less when designing a dose volume, because of the manner by which cereal flows into the holding stage, optionally including bridging. While a shape of a stage or cross sectional area of a holding stage may be varied, e.g., oval, circular, square, or rectangular, an exemplary side-to-side diameter or width can be in the range from 0.5 to 2 inches; exemplary front-to-back "depth" can be in the range from 0.25 to 1 inch. While top-to-bottom height can vary, an exemplary area can be from 0.25 to 3 cubic inches.

According to various embodiments of packages that include a reservoir, a reservoir can be of a volume sufficient to contain enough milk to facilitate removal of pieces of cereal. Exemplary volumes can be in the range from, e.g., 3 to 30 cubic centimeters, such as from 15 to 25 cubic centimeters or from 18 to 20 cubic centimeters.

Certain features related to a package of FIG. 1A, 1B, 1C, and 1D include a cereal holding stage and a milk channel. Cereal and milk are contained in separate containers until dispensed, e.g., until a user dispenses a desired amount of cereal and milk directly into the mouth by tipping the container. The upper container and lower container can be prepared, packaged, transported, and sold, separately or in combination; if in combination, the lower container can be sold (e.g., prepared, stored, transported, and packaged) with milk contained in the lower container, or alternately with the lower container empty. If the lower container is sold without milk, a consumer can add milk by detaching the lower container, placing milk in the lower container, and reattaching the lower container to the upper container. The cereal and milk are consumed by manipulating the package by tipping the package to deliver contents directly to the user's mouth in a manner similar to drinking from a cup or a soda can. Cereal and milk are delivered from their respective containers within the package, to a cereal holding stage near the cover opening at the top of the package (at the top of the upper container). The cereal holding stage is located at an upper end of a milk channel, and at a front side of a cereal channel extending to the upper container interior space, so the cereal and milk can be contacted or mixed within the cereal holding stage, just prior to delivery from the package. An amount of cereal that is delivered by tipping the package is a volume similar to the volume of the cereal holding stage. The amount, or "dose" delivered by a single tip of the package can optionally be interrupted by formation of a cereal bridge at the cereal passage. An increased amount of cereal may be delivered by optional manipulation (shaking) of the package, if desired.

Figure 1B:
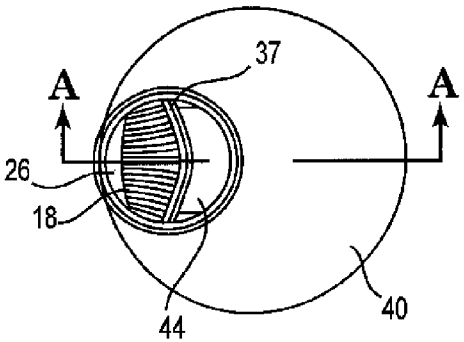
FIG. 1B is a top view of a package as described.
Figure 1A:
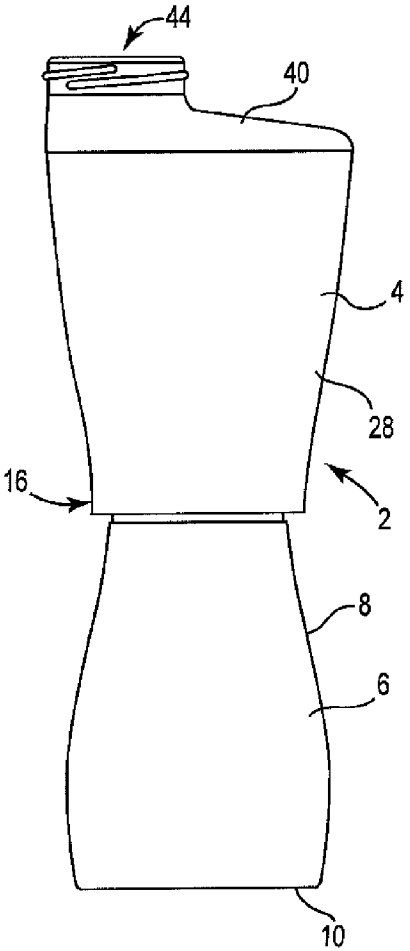
FIG. 1A is a side view of a package as described.
Figure 1G:
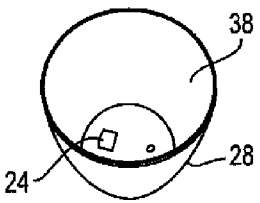
FIG. 1G is a top perspective view of a component of a package as described.
Figure 1I:
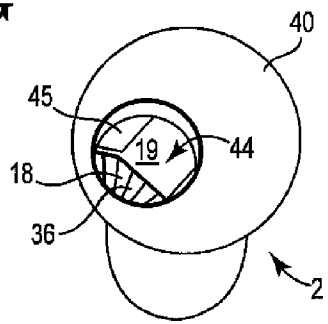
FIG. 1I and 1J are top perspective views of a package as described.
Figure 1J:
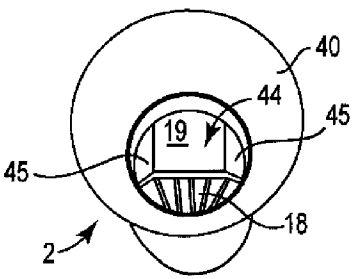
Figure 1F:
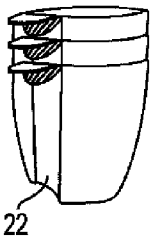
FIG. 1F is a perspective view of multiple pieces of a component of a package as described, in a stacked or nested arrangement.
Figure 1H:
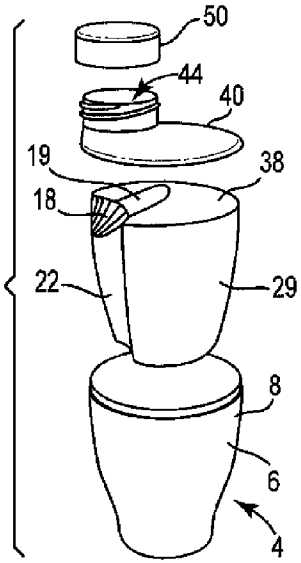
FIG. 1H is an exploded view of a package as described.
Figure 1E:
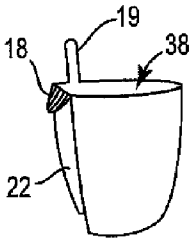
FIG. 1E is a perspective view of a component of package as described.
Figure 1D:
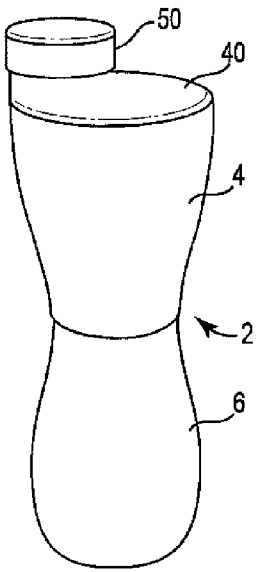
FIG. 1D is a perspective view of a package as described.

Referring to FIGS. 1A, 1B, and 1C, a combined milk and cereal package 2 includes two separate containers, upper container 4 and a lower container 6. Lower container 6 includes lower container sidewalls 8, lower container bottom 10, and lower container top opening 12, and can be engaged and sealed against upper container bottom 16 of upper container 4 at opposing engagement elements 11. Engagement elements 11 are not specifically illustrated but can be of any mechanical or adhesive nature, as described herein, such as a threaded engagement, snap-fit engagement, or other engagement that produces a liquid-tight seal. For example opposing surfaces of engagement elements 11 can have opposing threads that allow an internally-threaded aperture of upper container 4 to be screwed onto a threaded extension of lower container 6. Cover 40 has a three-dimensional form that creates coverspace 43 above upper container interior space 42 and above holding stage 36. Cover 40 includes upper cover opening 44, which can in turn be covered by a cover cap (not shown) such as a screw cap. Cover 40 and optional screw cap (not shown) can be made of plastic, paper, cardboard, foil, etc., with optional adhesive placed at one or more surfaces to secure a perimeter of cover 40 to a lip or edge of upper container 4. This embodiment shows cover 40 as a separate piece relative to upper container 4. Optionally these may be a single piece.

Lower container 6 is designed to hold milk during use. Optionally, milk can be contained in lower container 6 during transport or storage, in which instance the milk may be sealed in a separate package (e.g., a plastic bag or paper or cardboard carton or container) or a seal may be placed across opening 12 to seal the milk for refrigerated or ambient temperature storage.

Upper container 4 includes various features that may allow for improved delivery of cereal and milk relative to earlier products designed to store and deliver milk together with dry cereal. Generally, interior space 42 of upper container 4 functions to contain dry cereal during use. Upper container 4 is defined at different portions by bottom 16 (generally at a lower region of upper container 4), upper container outer sidewalls 28, upper container interior space sidewalls 29, upper container interior space opening 38, and holding stage opening 39. Upper container bottom 41 includes a venting aperture (not shown) to allow fluid communication and venting between upper container interior space 42 and space within lower container 6 that contains milk (i.e., lower container interior space). Upper container bottom 41 is three-dimensional and includes upper bottom level 12 at an inner region of the bottom and lower bottom level 14 at an annular outer region of bottom 41. Annular lower bottom portion 14 can function as a reservoir from which milk does not drain, if the venting aperture is placed at upper bottom level 12 or above, at a location above reservoir 16.

Additional features of upper container 4 shown at FIG. 1C include milk channel 22 that extends from lower milk channel opening 24 at bottom 16, to milk port 26 near holding stage 36. Milk channel 22 is defined on a front side by upper container outer sidewall 28 and on a backside by upper container interior space sidewalls 29. Milk channel 22 allows milk to flow from lower container 6, through milk channel 22, and be delivered through milk port 26 to cereal holding stage 36 to be combined with dry cereal and delivered from upper container 4, through cover opening 44, to the mouth of a consumer by tilting cereal package 2. Milk channel 22, as shown, e.g., at FIG. 1C, extends from a location at bottom 16, starting at lower milk channel opening 24 in communication with lower container 6, vertically along upper container outer sidewall 28, to milk port 26 in front of stage 18, and is further defined by internal milk channel wall (also upper container interior space sidewall) 29. Stage 18 extends in a slanted horizontal direction, allowing milk to drain through milk port 26 when the package is vertical. As illustrated, milk channel 22 does not extend completely to the top of sidewall 28 but ends at shelf 18 and milk port 26 (which define the bottom of cereal holding stage 36). Interior space 38 of upper container 4 is defined in part by bottom 16, sidewalls 28, and internal milk channel wall (also upper container interior space sidewall) 29.

Still referring to FIGS. 1A, 1B, and 1C, a venting aperture (or "air vent" not shown) allows air to flow between upper container 4 and lower container 6, to equalize pressure within an interior space of lower container, which contains milk, during delivery of milk from lower container 6 through milk channel 22. An air vent can be any structure that allows air to pass into lower container 6, which is otherwise sealed, as milk is delivered from lower container 6. For example, a vent can be a straw or channel ending at any location within upper container 4 or any other location external to lower container 6 that exhibits an ambient pressure. Pressure equalization produces consistent and smooth flow of milk through milk channel 22 and milk port 26.

At the top of milk channel 22 and within upper container 4, so as to be accessible to cereal contained in upper container interior space 42, is cereal holding stage 36. Cereal holding stage 36 is generally a space located above shelf 18, within upper container 4, at the top of milk channel 22. Cereal holding stage 36 is defined on a bottom by shelf 18, on a back and back sides by backwall 37, on a front bottom by milk port 26, and on a front and front sides by upper container outer sidewall 28. Cereal passage 45 allows cereal to pass—as package 2 is tipped forward—from upper container interior space 42, through coverspace 43, over backwall 37, into cereal holding stage 36. Cereal holding stage 36 is accessible through upper covering opening 44, through which cereal and milk can be dispensed by tipping container 2, after cereal and milk are contacted with each other at (or pass through) cereal holding stage 36. Cereal holding stage 36 also is in communication with upper container interior space 42 through cereal channel 45 in a manner to allow cereal to be transferred from upper container interior space 42 into cereal holding stage 36, by tipping cereal package 2, then further dispensed from package 2 at upper cover opening 44 by tipping package 2.

As illustrated a front sidewall (upper container inner sidewall 29) that defines a front of upper container interior space 42 is substantially vertical. According to alternate embodiments a front sidewall defining a front of upper container interior space 42 can be slanted to facilitate flow of cereal out of upper container interior space 42, through cereal channel 45 and into or through cereal holding stage 35 or cover opening 44. For example a front sidewall may be closer to the front of upper container 4 at an upper region of the front sidewall, and may be farther back (more distanced from) the front at the bottom (see FIGS. 2C and 2D showing a slanted front sidewall).

Cereal passage 45 is sized to allow movement of cereal pieces from upper container interior space 42 into cereal holding stage 36. Optionally, cereal passage 45 is sized to allow free movement of cereal pieces into holding stage 36 for a desired amount of time, or for a desired amount of cereal, followed by formation of a cereal bridge at cereal passage 45, to interrupt or stop further flow of cereal through cereal passage 45. The cereal bridge may be shaken loose, if desired, by the user, to deliver more cereal without un-tipping the package back to a vertical orientation.

When package 2 is transferred back to a vertical position from the tipped position used for dispensing, any amount of cereal that is in the cereal holding stage may remain there for delivery when the package is tipped the next time. Any milk that might remain in the cereal holding stage will be passed back through milk port 26 and return through milk channel 22 to lower container 6; re-separating the milk and cereal prevents the cereal from becoming soggy while being held at the cereal holding stage.

During use, when package 2 is tipped forward by a user in a manner to cause cover opening to be located below the contents of package 2, and toward the user's mouth, milk flows from lower container 6 through milk channel 22, through milk port 26 of shelf 18, to enter cereal holding stage 36. Cereal enters cereal holding stage 36 from upper container interior space 42 through cereal passage 45. The milk and cereal can be caused to flow into cereal holding stage 36 by user manipulation of package 2, especially by tilting the front part of package 2 (the side with milk channel 22 and cereal holding stage 36) forward, toward the user. Upon continued tilting the mixture of milk and cereal is delivered from package 2 by passing through upper cover opening 44.

One optional feature of the design of cereal package 2 is improved control of the amount of cereal ("dose") delivered to a consumer upon each instance of tilting the package. A cereal dose size can be controlled by factors that include the size of cereal holding stage 36 and cereal passage 45, as well as the size and density of cereal pieces, and optionally but not necessarily by formation of a cereal bridge. A total amount of cereal delivered will be an amount contained in the cereal holding stage, and any additional amount that can be caused to flow from upper container interior space 42 of upper container 4, through cereal passage 45, through or above cereal holding stage 36, and then out of cover opening 44, while package 2 is maintained in a tipped position.

Optionally cereal size and the size of cereal passage 45 may result in formation of a cereal bridge at cereal passage 45, after a certain amount of cereal is delivered, which may interrupt cereal delivery; cereal flow may be restarted by manipulation of package 2 by shaking, rolling, or additional tipping, to disrupt a cereal bridge and encourage additional flow of cereal from upper container interior space 42.

The size (e.g., volume) of a cereal holding stage can be any size that allows a desired flow of cereal into and through the holding stage; an exemplary volume can be, e.g., from 0.25 to 3 cubic inches, e.g., from 0.5 to 2 cubic inches. Exemplary dimensions of a shelf, which can correspond to dimensions at a bottom of a cereal holding stage, can be a combination of a width (side-to-side) and a depth (front-to-back) each independently within the range from 0.5 to 1.5 inch. Exemplary height (top to bottom) of a cereal holding stage can be in the range from 0.375 to 0.75 inch, although greater heights can also be used. Exemplary dimensions for cereal passage 45 can be, e.g., from about 12-23 millimeters high and 15-20 millimeters in width. Exemplary size and shape of cereal pieces used in combination with these dimensions of a cereal holding stage can be substantially round cereal pieces having average diameter in the range from 2 to 20 millimeters, which includes sizes of conventionally available cereals.

Another optional feature of the design of cereal package 2 is to control the rate and uniformity of a flow of milk delivered from milk port 26 to cereal holding stage 36 and to the user. The flowrate of milk through milk port 26 can be can be made substantially constant based on pressure equalization of the interior space of lower container 6, by flow of air through an air vent (not shown) as milk exits lower container 6, which is sealed, through milk channel 22, air flows into lower container 6 through air vent 32 to equalize pressure. The amount of milk flowing through milk channel 22 and through cover opening 44 (i.e., milk flowrate) can be controlled by factors that include the size of milk port 26. An exemplary milk flow rate can be, e.g., from 3.5 to 16 milliliters per second, and an exemplary milk port can be sized to achieve this flowrate.

A feature of described packages having separate milk and cereal containers, including package 2, is the ability to maintain dry cereal until right before use, i.e., until cereal and milk are dispensed together into cereal holding stage 36 and into a consumer's mouth. Keeping the cereal and milk separated during multiple dispensing (tipping) steps involving repetitive tipping can be a result of the milk being held back by the restricted size of milk port 26, which is only a portion of the size of shelf 18. When package 2 is set back to vertical from a tipped position, milk is directed back into lower container 6, through milk channel 22, to stay separated from the dry cereal in upper container interior space 42 of upper container 4. This keeps the cereal dry and crunchy. One result is that cereal is only briefly wetted or prehydrated with milk at the time that the cereal is mixed with the milk in the cereal holding stage, into a combined stream of milk and cereal, and upon at delivery from upper covering 44 directly to a user's mouth.

See also FIGS. 1D through 1J, having similar numbering and showing a package having many of the same features as that of FIGS. 1A, 1B, and 1C. Some of these include upper container 4 and lower container 6, cover 40. A cover cap 50 is also shown, which includes a threaded engagement to close cover opening 44. Milk channel 22 is defined by sidewalls 28 and 29 and extends toward lower container 8, in communication with lower container 6 through lower milk channel opening 24. Upper container interior space 38 is in communication with cereal holding stage 36 through cereal channels 45. "Tab" 19 is an additional and optional feature that can further define cereal channel 45. Tab 19 in the center of milk channel 45 prevents cereal from quickly passing through cover opening 45 when package 2 is tilted toward a user.

FIGS. 2A, 2B, 2C, and 2D illustrate a package that includes a container for containing cereal (e.g., an "upper container"), which may be attached to a lower container containing milk. Package 64 includes an upper container piece 60 and cover piece 62 comprising cover 63, perimeter 66, and cover opening 74. The three-dimensional form of cover piece 62 forms coverspace 65 located above upper container interior space 76, allowing communication between upper container interior space 76 and holding stage 86.

Upper container interior space 76, for containing cereal, is defined by bottom 78, back and side sidewalls 80 and front sidewall 82, and at an upper opening communicates with coverspace 65. Front sidewall 82 is slanted toward the front of the container; sidewall 82 is closer to the front at upper regions of the sidewall and is farther from the front at lower regions and at bottom 78. An example of the magnitude of the slant can be in the range from between 0 to 25 degrees when the upper container is held in a vertical direction, with perimeter 68 being in a horizontal plane.

Holding stage 86 is defined on a bottom by stage 87, at a back side by backwall 88, and on a front side by a front interior surface of cover 63, and is in communication above with coverspace 65, cover opening 74, and with upper container interior space 76 by way of cereal passage 90. Below holding stage 86 is milk channel 84, defined on a front side by extension sidewall 72 and on a back side by sidewall 82. Milk ports (illustrated but not numbered) in stage 87 allow milk to flow between milk channel 84 and holding stage 86.

Upper perimeter 70 at an upper region of upper container piece 60 includes an engagement element that engages an opposing engagement element of perimeter 66 of cover piece 62 to form liquid-tight engagement 92 around opposing perimeters 70 and 66. The engagement may be any useful liquid-tight engagement and as shown is a beveled shoulder at a perimeter 70, contacting an opposing structure at perimeter 66. The shoulder and opposing structure are made of material that allows the outer perimeter 66 to snap onto the beveled shoulder perimeter to produce liquid-tight engagement 92 between the two perimeters. Alternate engagements could also be used such as threaded engagements, a snap-fitting ridge and opposing outer ring structure, opposing mechanical detents, etc.

Upper container piece 60 also includes extension sidewall 72 extending from perimeter 70 of the upper container, at a location around and outside of the sidewall 80 and milk channel 84, extending toward and to a lower region of container 60. Perimeter 68 at a lower region of extension sidewall 72 includes an engagement element useful to attach a lower region of upper container 60 to an upper region of a lower container in a liquid-tight manner. As illustrated the engagement element at perimeter 68 is a snap-fit annular rounded ridge, but other types of engagement elements an be used.

Bottom 78 is located at or above perimeter 68 and the engagement element of perimeter 68. In alternate embodiments perimeter 68 may be above or below bottom 78 (e.g., extension sidewall 72 may be longer or shorter, extending to a different location relative to bottom 78) and the engagement element of perimeter 68 can be located differently in a corresponding manner.

Perimeter 68 defines bottom opening 96 that, when upper container 60 is engaged with a lower container at perimeter 68, allows fluid communication between the upper container and the lower container. Optionally bottom 78 can be vented to allow communication between interior space 76 and a lower container, and milk channel 84 will also be in communication with the lower container when attached at perimeter 68.

For packaging and sale of package 64 (containing cereal at interior space 76) separate from a milk container, bottom opening 96 can be covered and sealed, e.g., by a foil, paper, plastic sheet, etc., e.g., by us of adhesive around perimeter 68; the cover and seal can be removed by a consumer immediately before attaching upper container piece 60 to a lower container that contains milk.

Figure 2B:
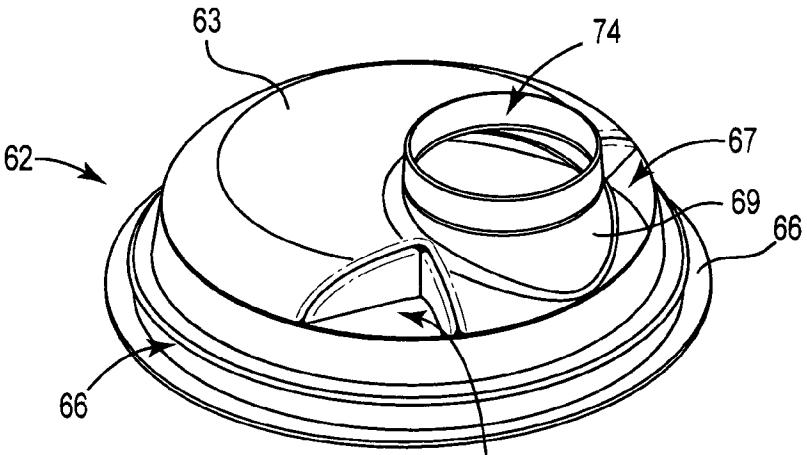
FIG. 2B is a side perspective view of a piece of a package as described.
Figure 2A:
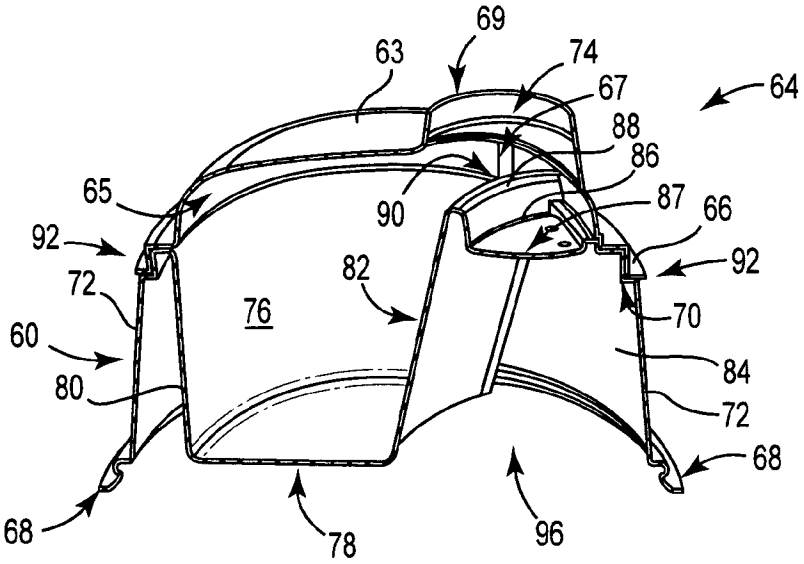
FIG. 2A is a side cut-away view of a package as described.
Figure 2C:
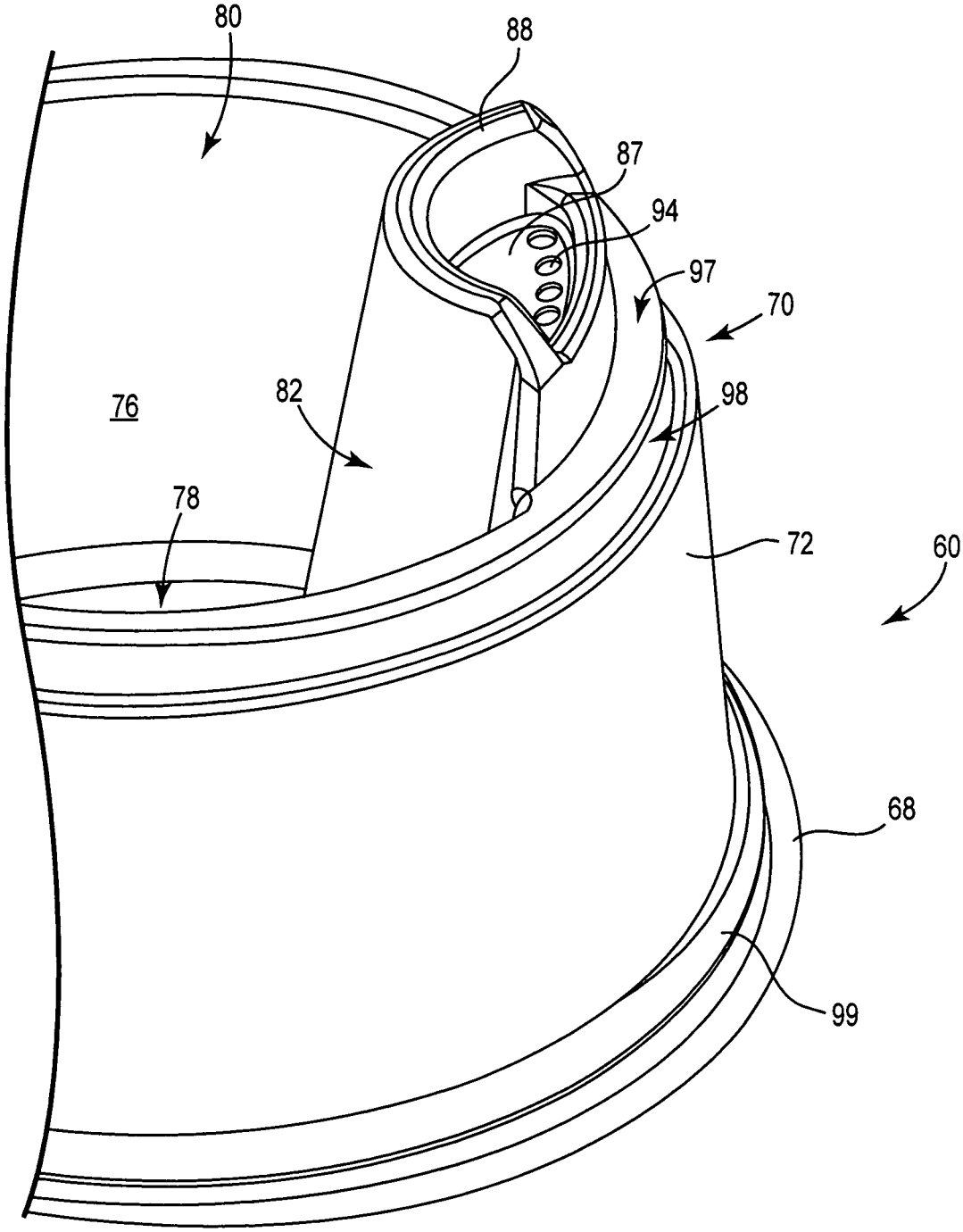
FIG. 2C is a side perspective view of a piece of a package as described.
Figure 2D:
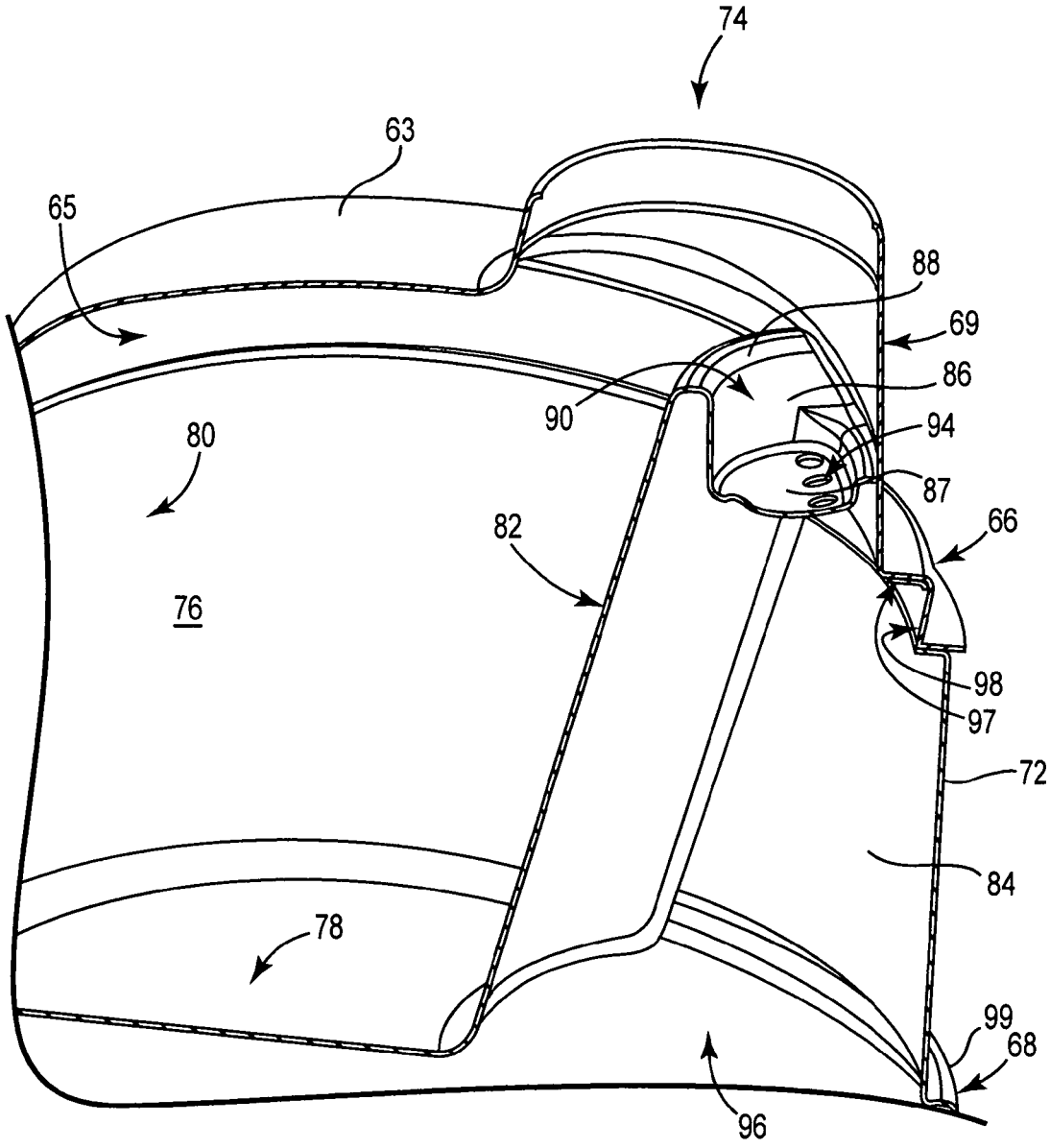
FIG. 2D is a side cut-away view of a package as described.

As shown at FIG. 2B, cover piece 62 can include a vertical mouthpiece 69 extending generally upward from cover 63 to define cover opening 74. Mouthpiece 69 can facilitate dispensing milk and cereal to a mouth of a user. Also at FIG. 2B are shown optional indents 67 that protrude inward from cover 63 into coverspace 63 at a front region of cover 63, on opposing sides of mouthpiece 69. Indents 67 can optionally be included in cover 63 to partially define boundaries of a holding stage, cereal channel, or coverspace, e.g., to direct flow of cereal from an upper container interior space to a holding stage or to a cover opening. FIG. 2A points out interior surfaces of indents 67 in relation to cover piece 67 and features at the front thereof. Cover piece 63 illustrated at FIG. 2D does not include indents, which are optional.

FIG. 2C is a detailed view of upper container piece 60 showing features as described, further showing details of milk ports 94, the beveled shoulder engagement element at perimeter 70, and snap-fitting rounded ridge engagement element 99 at lower perimeter 68. The beveled shoulder includes horizontal shoulder surface 97, which as illustrated is substantially horizontal when upper container piece 60 is held vertically, and beveled shoulder surface 89. Beveled shoulder surface 89 extends around perimeter 68 in a generally planar ring manner as a surface that is substantially vertical when upper container piece 60 is held vertically; surface 98 can be slightly slanted from vertical, i.e., beveled, so the diameter of the ring at the upper region of surface 98 (connected to horizontal surface 97) is slightly larger than the diameter of the ring lower levels. An example of an angle of the bevel may be, e.g. from about 0 to 15 degrees from vertical. The larger diameter at the top allows a corresponding engagement element on a perimeter of a cover piece to be snapped over the beveled shoulder to produce a liquid-tight engagement.

FIG. 2D is a detailed view of upper container piece 60, engaged with cover piece 60.

Figure 3A:
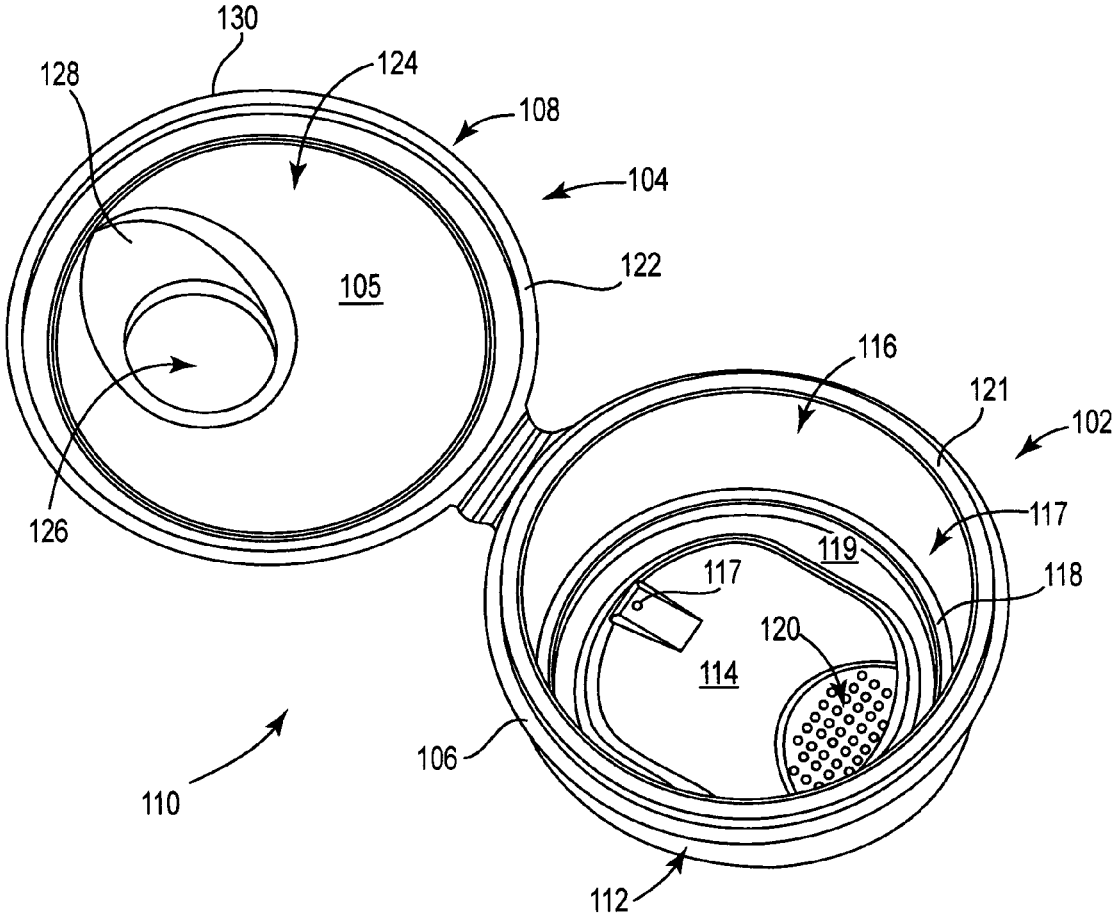
FIG. 3A is a top perspective view of pieces of a package as described.
Figure 3D:
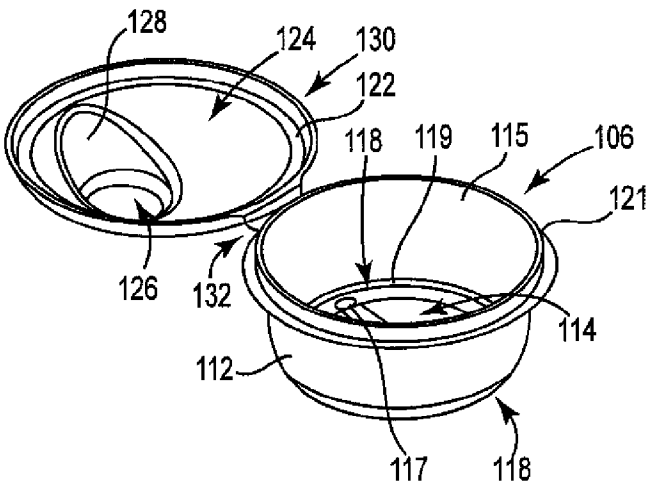
FIG. 3D is a top perspective view of a piece of a package as described.
Figure 3B:
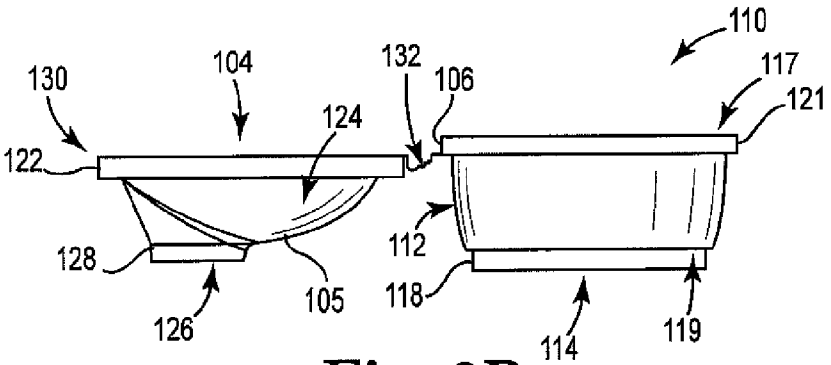
FIG. 3B is a side view of pieces of a package as described.
Figure 3C:
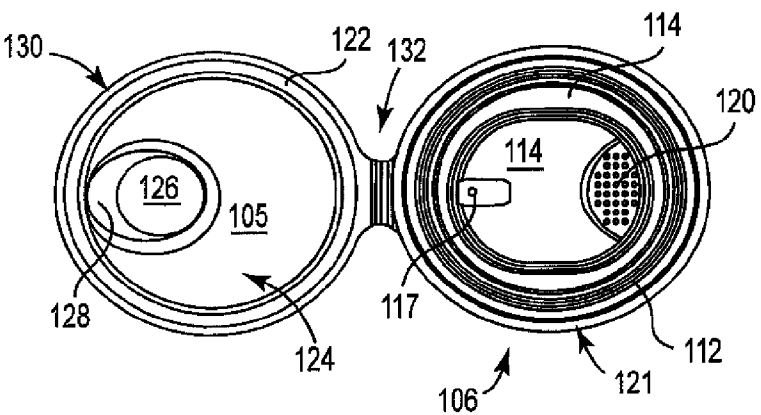
FIG. 3C is a top view of pieces of a package as described.

FIGS. 3A, 3B, 3C, and 3D illustrate an embodiment of a package as generally described, having an interior space and a reservoir. Referring to FIG. 3A, package 110 includes a first container piece 102 for containing a dry food (e.g., cereal), also sometimes referred to as an "upper container piece" when engaged at a location above a "lower" milk container. Package 110 also include cover piece 104.

First container piece 102 and cover piece 104 are separate pieces that engage in a liquid tight manner at perimeters 106 and 108 of first container piece 102 and cover piece 104, respectively. The structures of these pieces embody two separate pieces of a container (110) that can be attached and separated, but according to other embodiments may be part of an integral, single piece container. Optional hinge 132 connects the pieces.

First container piece 102 includes sidewalls 112, three-dimensional bottom 114, container inner space 116, and perimeter 106 at an upper region of container piece 102 including engagement element 121. Interior space 116 can be considered to be defined on sides by sidewalls 112, on a bottom by bottom 114, and on top by aperture 115 bounded by a perimeter of an upper region of sidewalls 112. Bottom 114 includes back aperture 117, which allows venting of interior space 116 with a space below. Bottom 114 additionally includes front apertures 120 which allow for fluid (e.g., milk) passage between interior space 116 and a space below. At a lower region of container 110 is lower engagement element 118, as illustrated, in the form of a shoulder. Reservoir 119 extends around a perimeter of bottom 114 in an annular fashion, at a location below apertures 118 and 120, to allow milk to pool in reservoir 119 when package 110 is held vertically.

Cover piece 104 includes cover, coverspace 124, cover opening 126, mouthpiece 128, and perimeter 130 that includes engagement element 122 that engages opposing engagement element 121 in a liquid-tight manner.

A feature of the multi-piece package illustrated at FIGS. 3A through 3D is that the upper container interior space does not extend into a lower container interior space, when placed above a lower container. According to alternate package embodiments, sidewalls or a bottom that define an upper container interior space may be located within the lower container interior space when the upper container piece is engaged above a lower container piece.

Figure 4B:
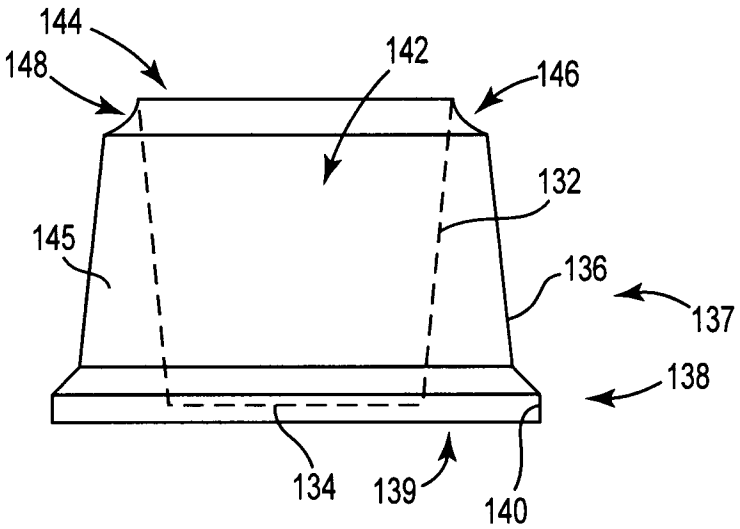
FIG. 4B is a front view of a package or piece of a package as described.
Figure 4A:
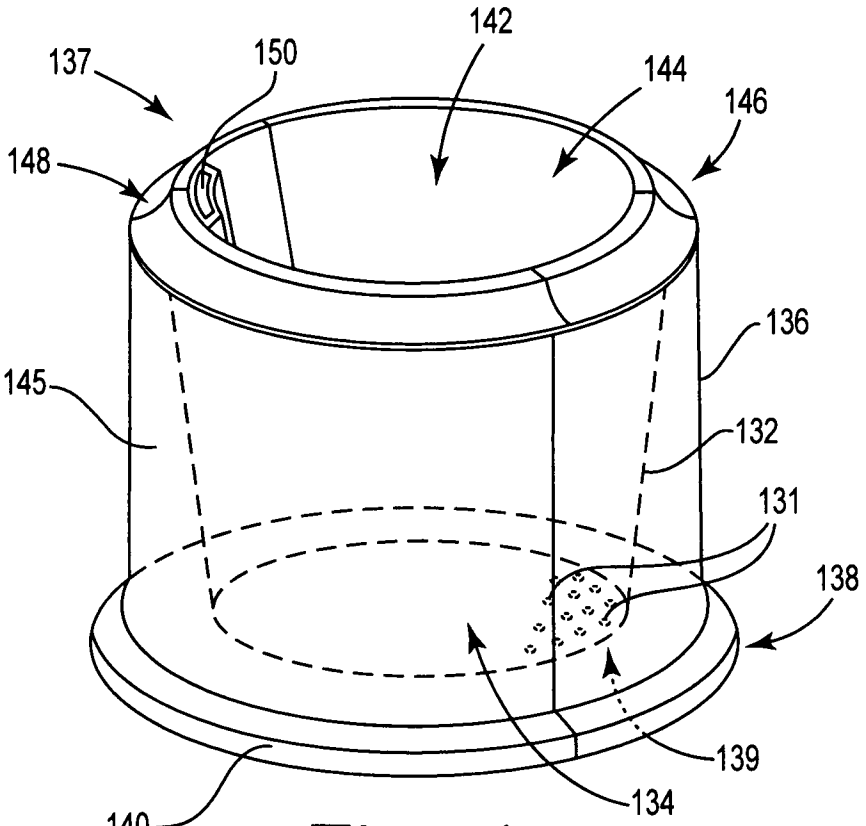
FIG. 4A is a perspective view of a package or piece of a package as described.
Figure 4C:
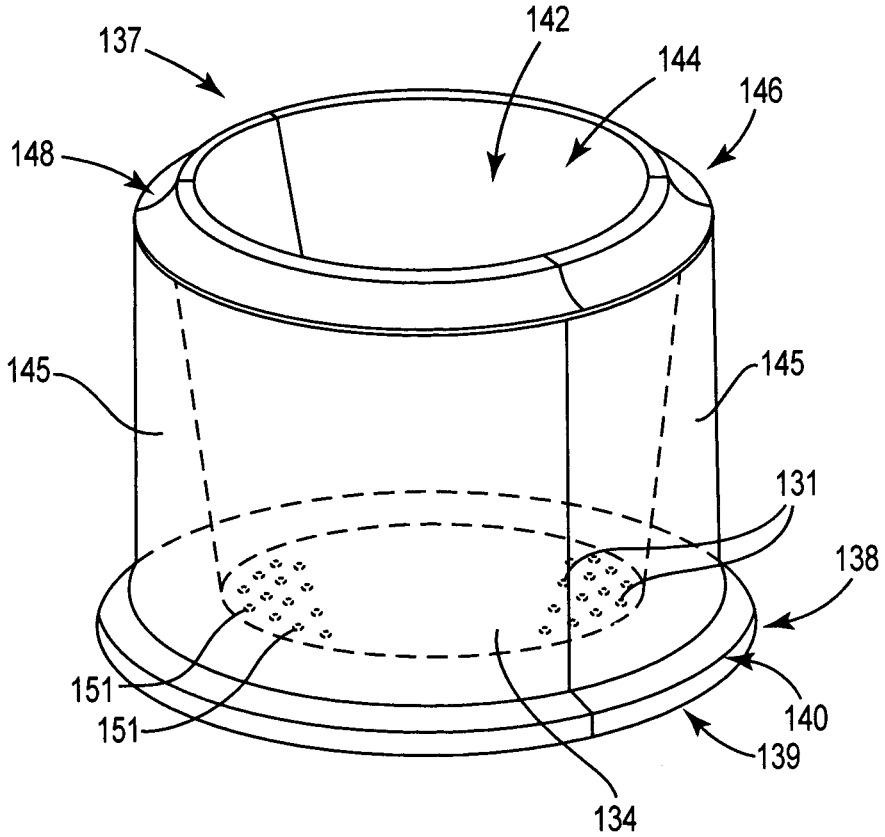
FIG. 4C is a perspective view of a package or piece of a package as described.

FIGS. 4A, 4B, 4C, and 4D illustrate an embodiment of a container or container piece as generally described, having an interior space for containing dry food such as cereal (e.g., an upper container interior space) and optionally a reservoir (not shown at FIGS. 4A, 4B, and 4C, but optionally present). Referring to FIG. 4A, container piece 137 is useful as a container for containing dry food such as cereal. Container piece 137 can also sometimes referred to as an "upper container piece" when engaged at a location above a "lower" milk container. Perimeter 146 at an upper region of container piece 137 includes engagement element 148, illustrated to be a shoulder structure but optionally another engagement element. Interior space 142 can be considered to be defined on sides by inner sidewalls 132, on a bottom by bottom 134, and on top by aperture 144 bounded by an upper region of sidewalls 132. Apertures 131 are located at a back half of bottom 134 to allow venting between interior space 142 and a space below, such as a lower container interior space located below when container piece 140 is engaged at an upper region of a milk container.

Container piece 137 also includes extension sidewalls 136 extending from perimeter 146 in a generally downward direction to lower perimeter 138, which includes engagement element 140 in the form of a generally planar ring that allows a snap-fit engagement with a rounded or otherwise correspondingly shaped rim of a lower container such as a plastic cup or glass. Perimeter 138 also defines lower opening 139.

Channel space 145 is defined between inner sidewalls 132 and extension sidewalls 136. In the embodiment of FIGS. 4A and 4B, channel space 145 is in fluid communication with milk port 150 (see FIG. 4A) located at an upper region of sidewalls 132 and 136, and at a front perimeter of an upper region of interior space 142. In this embodiment, bottom 134 does not include a front aperture to allow a front side of interior space 142 to communicate with a lower container interior space when container piece 137 is engaged above a lower container, e.g., for milk to flow from a lower container interior space into interior space 142 when package piece 140 is tipped forward. Instead, milk can flow from a lower container interior space, through a front side of aperture 139, through channel space 145, and through milk port 150, directly into a user's mouth without passing through interior space 142, the milk avoiding contact with cereal located inside of interior space 142.

FIG. 4C shows a slight variation on the piece of FIG. 4A: front apertures 151 are included in bottom 134, and milk port 150 has been removed. In this embodiment, when package piece is tipped forward, milk can flow from a lower container interior space, through a front side of aperture 139 and through front apertures 151, passing through interior space 142 and contacting cereal located inside of interior space 142, then through aperture 144 and into a user's mouth.

FIGS. 4A, 4B, and 4C do not show a cover piece or a cover. An optional cover or cover piece (optionally including a three-dimensional cover that defines a coverspace (a volume below the cover)), or alternately flat (planar, two-dimensional, and not three-dimensional) could be included in combination with container piece 137, e.g., to cover interior space 142, optionally by connecting to perimeter 146, e.g., by a liquid-tight engagement at engagement element 148.

Figure 4D:
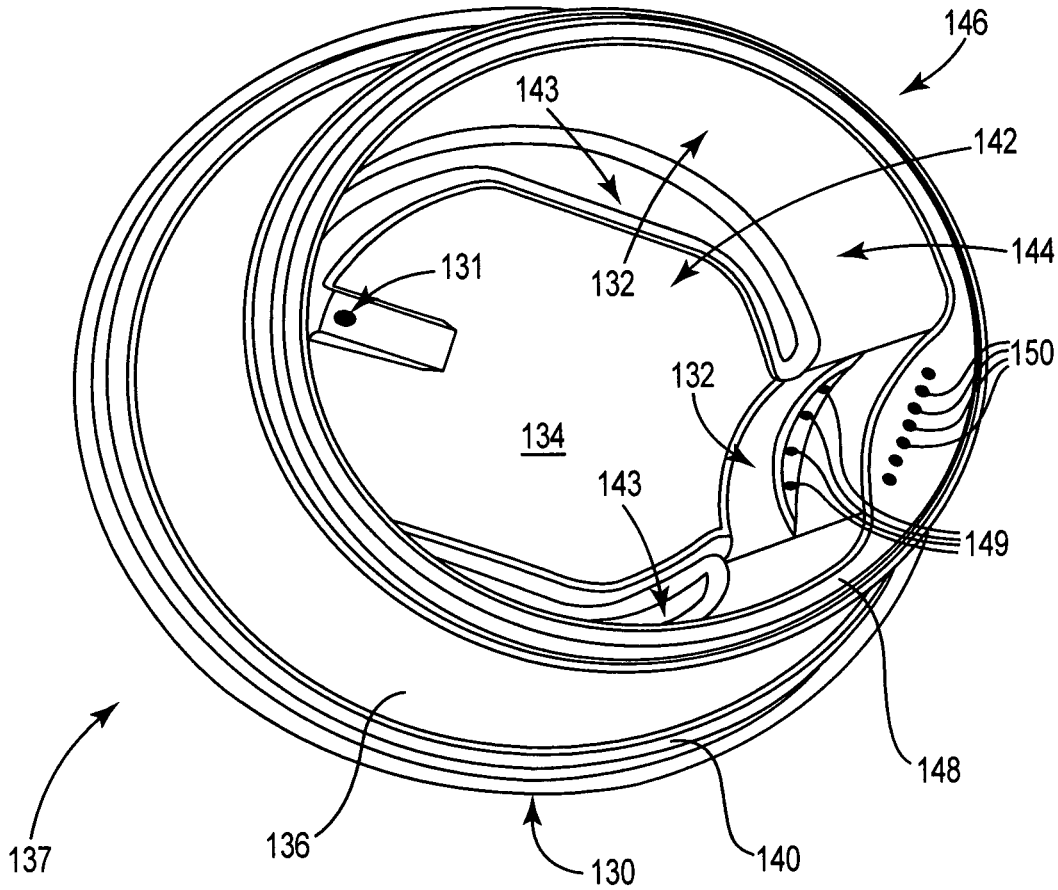
FIG. 4D is a perspective view of a package or piece of a package as described.

FIG. 4D shows a variation on the piece of FIG. 4A or 4B: milk port 150 at an upper region of channel space 145 is still present, and additional milk ports 149 are added at a middle region of interior space 142 and channel space 145. Milk ports 149 are apertures in a front side of sidewall 132 that connect channel space 145 to interior space 142 so milk can flow from channel space 145 to interior space 142 during use (tipping and un-tipping back to vertical), generally flowing into interior space 142 in an amount sufficient to fill reservoir 143. Reservoir 143 is an annular or ring-shaped volume located at an outer perimeter of bottom 134, at a level below aperture 151. In this embodiment, when package piece 140 is tipped forward, milk can flow from a lower container interior space below container piece 137, through a front side of aperture 139 (at the bottom of container piece 137, but not shown), through milk channel 145 (in front of sidewall 132 at a front of interior space 142) and through milk ports 149 and 150, eventually being dispensed with cereal from interior space 142 into a user's mouth. Engagement element 140 can be designed to snap fit onto a standard plastic drinking glass or cup.

A feature of the multi-piece packages illustrated at FIGS. 4A through 4D is that the upper container interior space does not extend into a lower container interior space, when placed above a lower container. According to alternate package embodiments, sidewalls or a bottom that define an upper container interior space may be located within the lower container interior space when the upper container piece is engaged above a lower container piece.

Another embodiment of a combined cereal and milk package is illustrated at FIGS. 5A through 5I. Package 270 can be a package that can be stored and offered for sale while containing dry cereal (in an upper container) and milk (in a lower container) for consumption, each in a separate container. The milk may be refrigerator-stable or shelf stable milk.

During use, upper container 272, containing dry cereal, is removed from the lower container (milk chug) (274). A cover such as a foil that covers and seals an opening in the lower container is removed. A valve (containing one or more apertures) can cover a lower opening of the upper container at a location where the lower opening attaches to an upper opening of the lower container; the valve can include a mechanical screen (or "sieve") that allows milk to flow through the valve but does not allow passage of pieces of cereal. A reservoir (291) can be included at a location at a bottom of upper container 272. Generally, a reservoir is a volume below the level of apertures of a valve or other apertures, that can contain an amount of milk after an amount of milk has drained through the valve into the lower container.

Figure 5C:
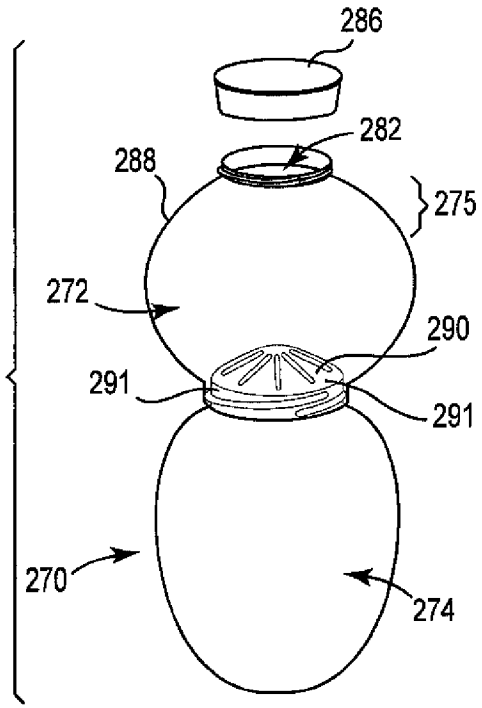
FIG. 5C is an exploded perspective view of a package as described.
Figure 5B:
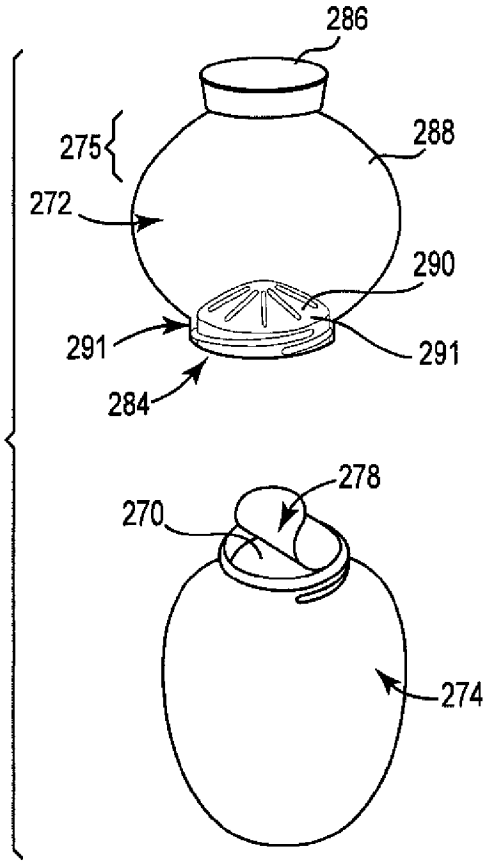
FIG. 5B is an exploded perspective view of pieces of a package as described.
Figure 5A:
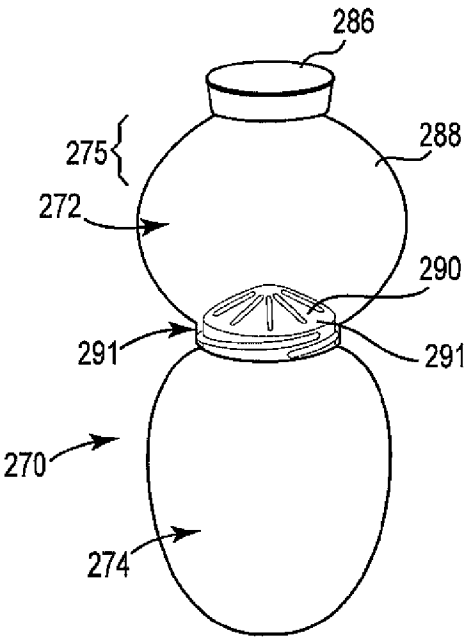
FIG. 5A is a perspective view of a package as described.
Figure 5E:
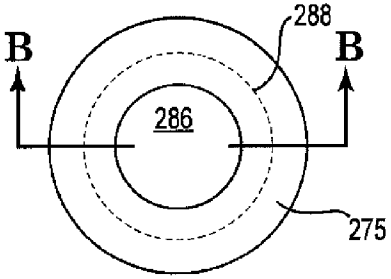
FIG. 5E is a top view of pieces and packages as described.
Figure 5F:
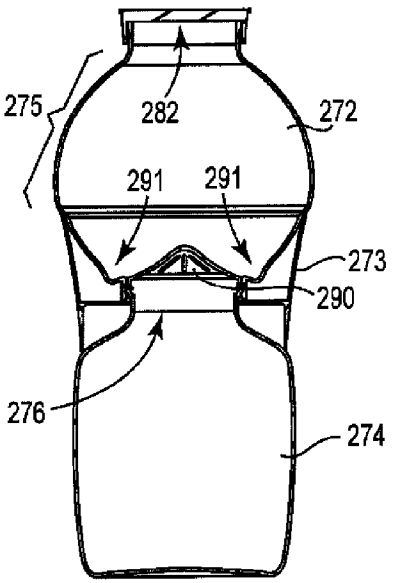
FIG. 5F is a cross-sectional view of pieces and packages as described, taken along line B-B of FIG. 5E.
Figure 5D:
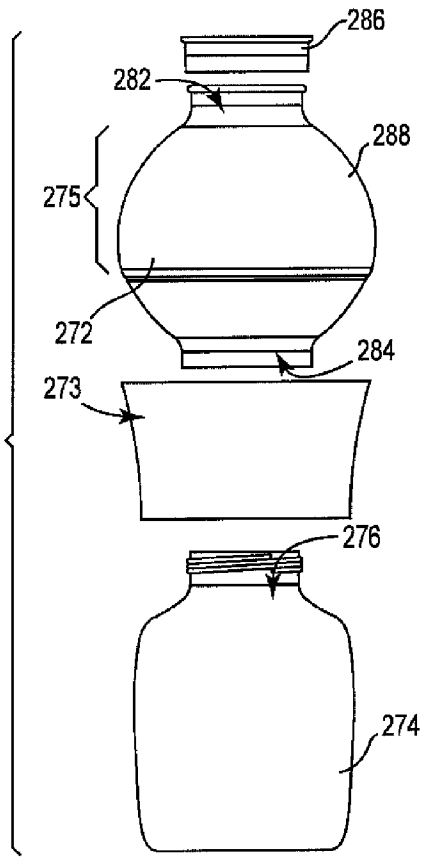
FIG. 5D is a front exploded view of pieces and packages as described.

An upper container such as upper container 272 generally includes sidewalls and a cover, which, as in FIGS. 5A, 5B, etc., are shown to be embodied by a single continuous generally cylindrical piece element. The cover is optional, and may be integral to the upper container, integrally connected to sidewalls. In alternate embodiments, sidewall and cover features of an upper container are separated into different "pieces," e.g., depending on how the upper container or pieces of an upper container are manufactured. An upper container can also include a lower region (e.g., lower half or lower third by vertical height of an upright (vertical) package) that includes an engagement element for engaging a second container, e.g., a "lower container" that contains milk or another liquid, in a liquid-tight manner.

A removable cap can cover an upper opening (e.g., cover opening) of the upper container. After the cover is removed from the lower container opening, the upper container is replaced on the (lower container) opening with the valve now separating the interior space of the upper container from the interior space of the lower container, at the location where the lower opening of the upper container is attached to the opening of the lower container. The valve allows milk to pass from the lower container into the upper container, when the package is tipped. The removable cap located at an upper opening (cover opening) of the upper container can be removed and the user can consume the mixture of milk and cereal from the package by tipping the package to deliver the cereal and milk directly to the consumer's mouth, from the opening in the upper container (cover opening). The valve that separates the upper container from the lower container allows milk to pass back into the lower container when the package is tipped back to vertical, to maintain separation of the milk and cereal, preventing the cereal from becoming soggy.

Reservoir 291 is a volume within the interior space of the upper container, below the valve apertures or other apertures that make up the valve. While milk drains through the valve, reservoir 291 can retain a small amount of milk for use in consuming cereal from the upper container. For example, after most milk and cereal are used, a small amount of cereal may remain on sides or a bottom of the upper container. Milk retained in the reservoir may be used collect a small amount of remaining pieces of cereal by swirling the milk around the interior surfaces of the upper container interior space, collecting the pieces sticking to those interior surfaces. Once collected the pieces and the milk can be dispensed through the cover opening.

Referring to FIG. 4A, package 270 includes upper container 272 and lower container 274. Upper container 272 can contain dry cereal for storage, marketing, transport, and sale to a consumer. Upper container 272 includes upper opening (cover opening) 282, sidewalls 288, bottom opening 284, cover cap 286 that covers cover opening 282, and valve 290 located within bottom opening 284. Upper region 275 of upper container 272, integral with sidewalls 288, can generally be considered a "cover," e.g., a three-dimensional cover as illustrated, extending over interior space of upper container 272, even though the cover is integral to the sidewalls and is not a separate piece; in alternate embodiments the cover can be a separate piece.

Cover cap 286 is engaged (e.g., by threads, a snap fit, or another mechanical or adhesive closure mechanism) to close and optionally seal upper opening 282.

Reservoir 291 is a three-dimensional volume located at a generally planar, ring-like, or annular location around valve 290 at a bottom of an interior space of upper container 272.

Lower container 274 includes (upper) opening 276, covered and sealed by removable (e.g., peelable) cover 278 that may be made of plastic, paper, or foil, and that can be secured to (upper) opening 276 of lower container 274, e.g., by adhesive. Lower container 274 can contain milk in an interior space; the milk can be refrigerated or shelf stable, for storage, marketing, transport, and sale to a consumer.

An upper region of upper container 272, near opening 276, includes an engagement element that engages opening 276 of lower container 274 in a sealing engagement that is tight to liquids, for example by a threaded engagement or a snap fit. Upper container 272 is shaped to have convex sidewalls (288) (including upper region 275 that can be considered to constitute a "cover") to facilitate flow of cereal, milk, and wetted cereal, along sidewalls 288 without the wetted cereal sticking to the sidewalls. After cover 278 is removed and upper container 272 is re-attached to lower container 274, package 270 contains milk in lower container 274 and dry cereal in upper container 272, with the milk and dry cereal being separated by valve 290, which has openings (apertures) that allow milk to flow between the two containers but that do not allow cereal pieces to pass from upper container 272 into lower container 274. To dispense a mixture of cereal and milk, a user tips package 270 to cause milk to flow from lower container 274, through upper container 272 and out of (cover) opening 282, which also causes cereal to flow from upper container 272 out of (cover) opening 282; the mixture of cereal and milk can be dispensed from (cover) opening 282, e.g., directly to a user's mouth. The shape of the upper container is selected to maintain uninterrupted flow from the base (i.e., from lower container 274) to the mouth of the user. Sharp turns and ledges are undesirable.

When package 270 is un-tipped back to vertical, during use, an amount of milk contained in the interior space of upper container 272 drains through valve 290, while a certain amount of milk remains held by reservoir 291 in the upper container.

Figure 5G:
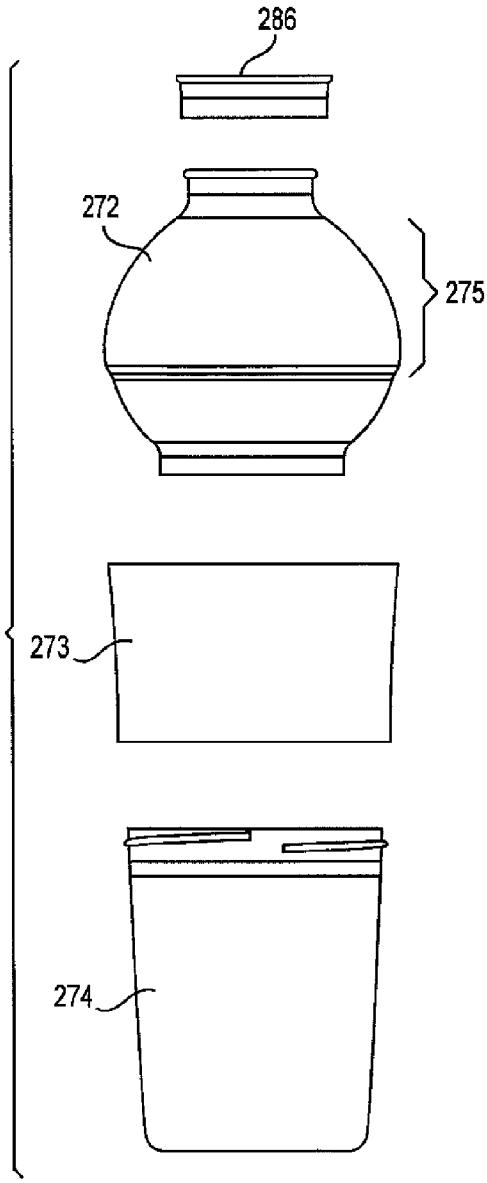
FIG. 5G is a front exploded view of pieces and packages as described.
Figure 5H:
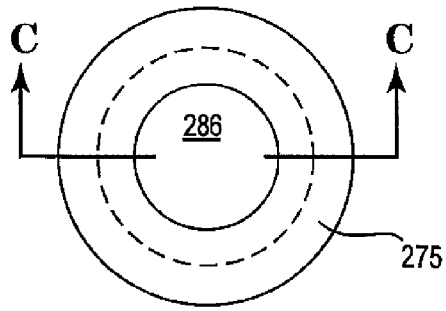
FIG. 5H is a top view of pieces and packages as described.
Figure 5I:
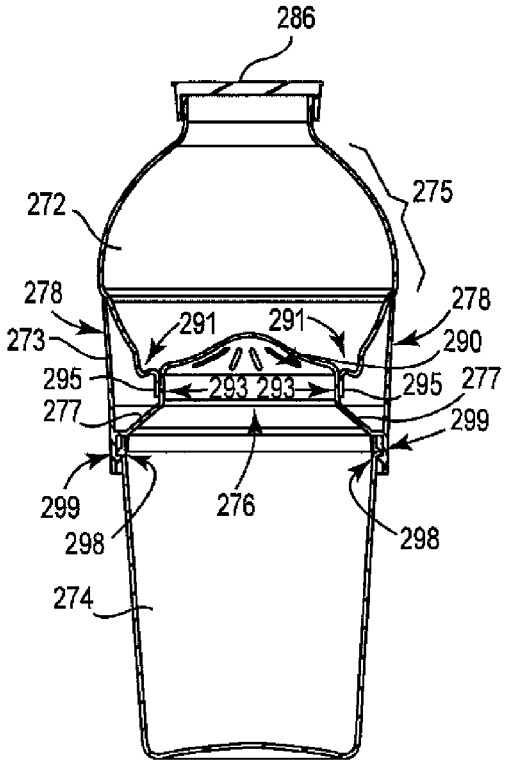
FIG. 5I is across-sectional view of pieces and packages as described, taken along line C-C of FIG. 5H.

See also FIGS. 5D through 5I, showing variations of package 270 that additionally include features such as connector 273 placed between upper container 272 and lower container 274. In FIGS. 5G through 5I, lower container 274 has a widened upper opening 276, and valve 290 is partially defined by connector 273; connector 273 includes valve 290 and sidewalls 278 connected by connecting wall 277. Outer perimeter 293 of connector 273 engages engagement element 295 of upper container piece 272 in any liquid-tight manner. Threads 298 of lower container 274 engage engagement element (threads) 299 of connector 273 in a liquid-tight manner.

Another embodiment of a combined cereal and milk package is illustrated at FIGS. 6A through 6I. Features of the illustrated package can include a package that can be stored and offered for sale while containing dry cereal and milk for consumption, each in a separate container. Optionally the upper cereal container can be prepared, transported, and sold separate from the lower milk container. The milk may be refrigerator-stable or shelf stable milk. During use the upper container, containing dry cereal, (if optionally sold in combination with the lower container) is removed from the lower container (milk chug). A cover such as a foil that covers and seals an opening in the lower container is removed. A valve can cover a lower opening of the upper container at a location where the lower opening attaches to an upper opening of the lower container; the valve can include a mechanical screen that allows milk to flow through the valve but does not allow passage of pieces of cereal. A reservoir is also present at a lower region or bottom of the interior space of the upper container, below apertures of a valve or other apertures. A removable cover cap can cover and seal an upper opening of the upper container. After the cover cap is removed from the lower container opening, the upper container can be placed or replaced on the lower container opening with the valve now separating the interior space of the upper container from the interior space of the lower container, at the location where the lower opening of the upper container is attached to the (upper) opening of the lower container. The valve allows milk to pass from the lower container into the upper container, when the package is tipped; the reservoir retains a small volume of milk as other mild drains back through the valve to the lower container during use. The removable cover cap located at an upper (cover) opening of the upper container can be removed and the user can consume the mixture of milk and cereal from the package by tipping the package to deliver the cereal and milk directly to the consumer's mouth, from the cover opening. The valve that separates the upper container from the lower container allows milk to pass back into the lower container but keeps cereal in the upper container to maintain separation of the milk and cereal, preventing the cereal from becoming soggy. The reservoir retains a small amount of milk or use in dispensing cereal pieces.

Figure 6C:
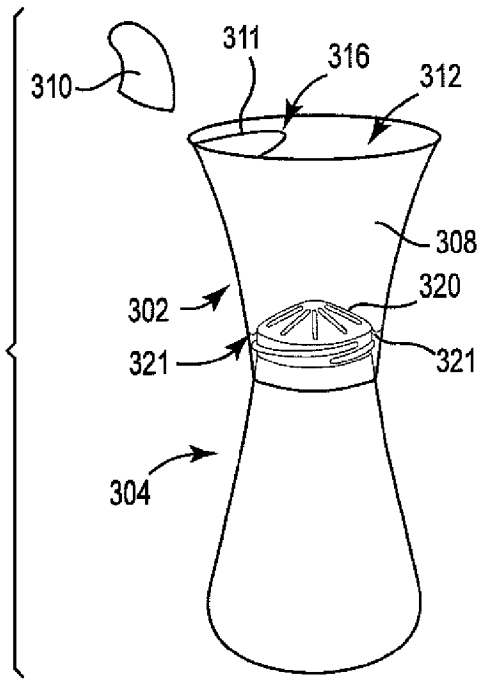
FIG. 6C is an exploded perspective view of a package as described.
Figure 6B:
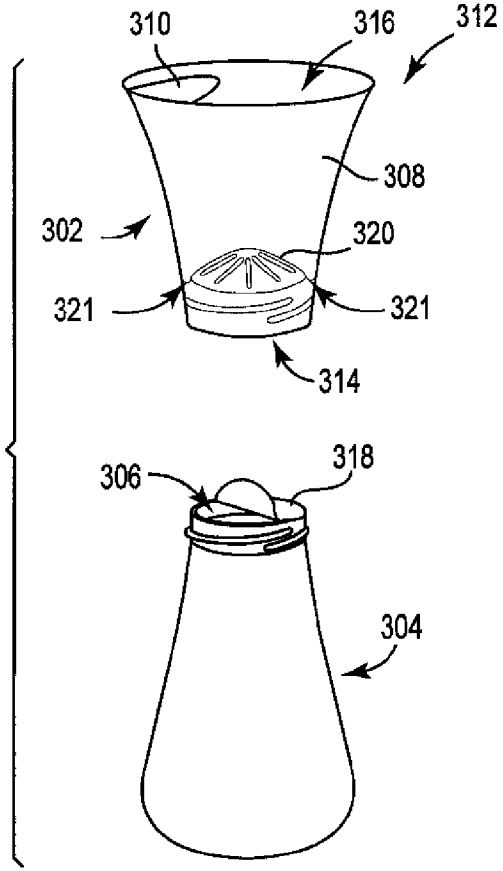
FIG. 6B is an exploded perspective view of pieces of a package as described.
Figure 6A:
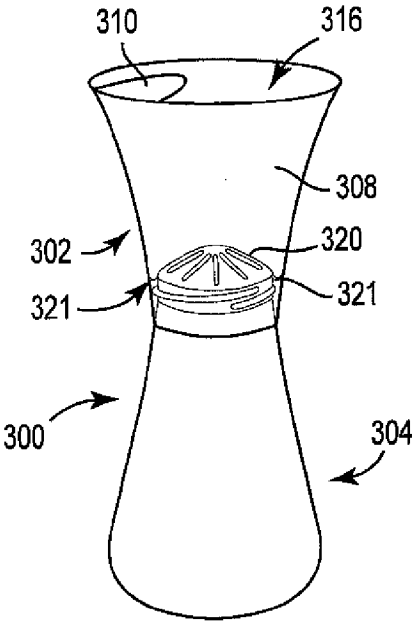
FIG. 6A is a perspective view of a package as described.
Figure 6E:
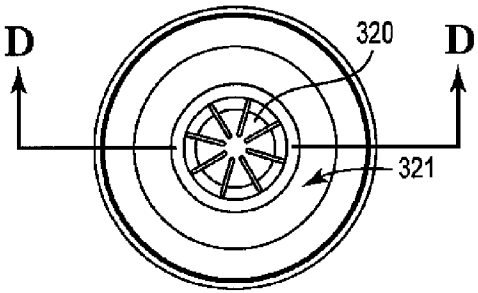
FIG. 6E is a top view of pieces and packages as described.
Figure 6F:
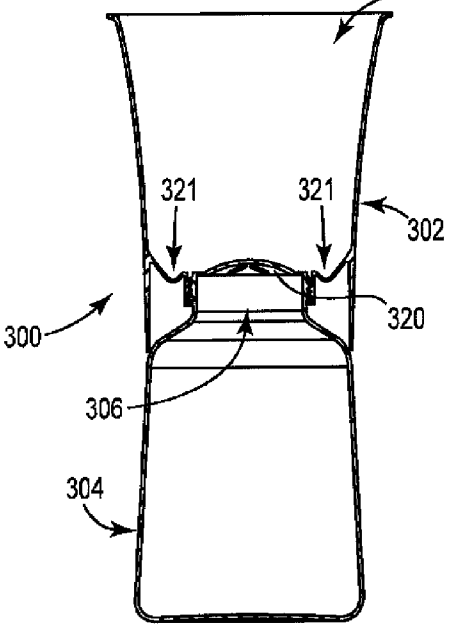
FIG. 6F is a cross-sectional view of pieces and packages as described, taken along line D-D of FIG. 6E.
Figure 6D:
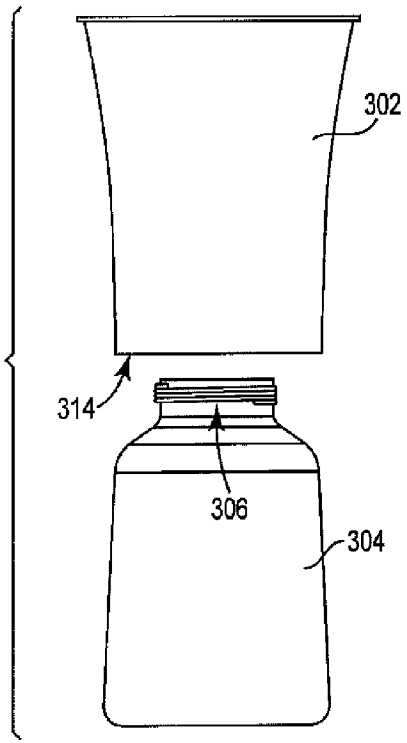
FIG. 6D is a front exploded view of pieces and packages as described.
Figure 6H:
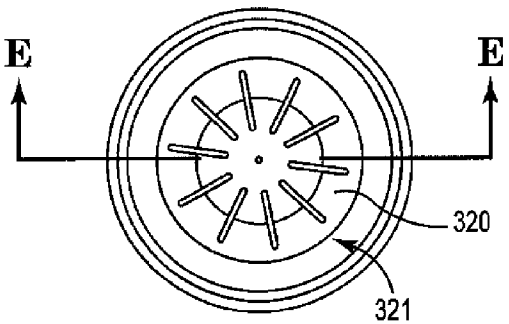
FIG. 6H is a top view of pieces and packages as described.
Figure 6I:
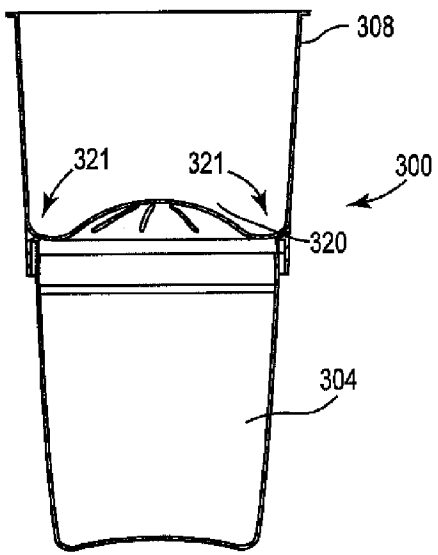
FIG. 6I is a cross-sectional view of pieces and packages as described, taken along line E-E of FIG. 6H.
Figure 6G:
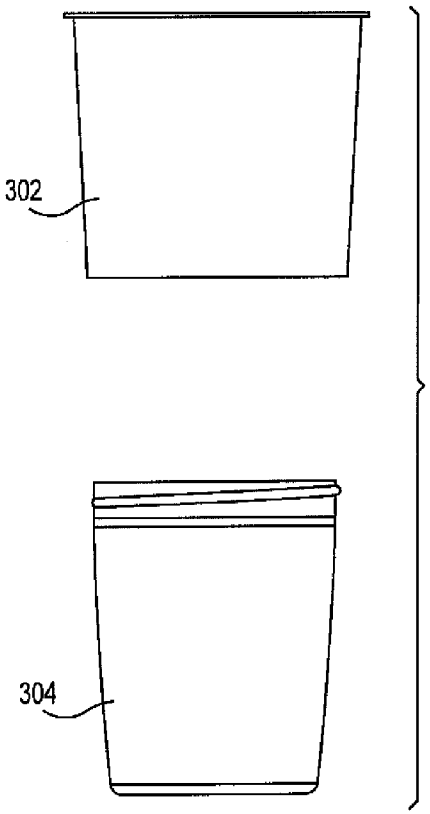
FIG. 6G is a front exploded view of pieces and packages as described.

Referring to FIG. 6A, package 300 includes upper container 302 and lower container 304. Upper container 302 can contain dry cereal for storage, marketing, transport, and sale to a consumer, optionally separately or in combination with lower container 304. Upper container 302 includes upper opening 312, sidewalls 308, bottom opening 314, cover 316 that covers upper opening 312 except for cover opening 311, and tab 310 that covers opening 311 in cover 316. Cover 316 is adhesively secured in a liquid-tight manner to the upper rim around an upper perimeter of sidewalls 308 around upper container 302. Tab 310 is adhesively secured to cover 316 around edges of cover opening 311, and on a front side to the upper rim of sidewall 308 near opening 311. Valve 320 is located within opening 314 of upper container 302, and allows liquids (e.g., milk) to pass through in either direction, but does not allow cereal pieces to pass from upper container 302 into lower container 304. Reservoir 321 extends in a generally planar ring or annular form, around valve 320, at a bottom of interior space of upper container 302, and at a level below apertures of valve 320.

Lower container 304 includes opening 306 covered and sealed by removable (e.g., peelable) lower container opening cover 318 that may be made of plastic, paper, or foil, and that can be secured to opening 306 of lower container 304, e.g., by adhesive. Lower container 304 can contain milk, which can be refrigerated or shelf stable, for storage, marketing, transport, and sale to a consumer.

Opening (lower) 314 of upper container 302 includes an engagement element that engages an opposing engagement element at upper opening 306 of lower container 304 in a sealing engagement that is tight to liquids, for example by a threaded engagement (as illustrated) or a snap fit. Upper container 302 is shaped to have convex sidewalls (308) to facilitate flow of cereal, milk, and wetted cereal, along sidewalls 308 without the wetted cereal sticking to the sidewalls. After cover 318 is removed to uncover opening 306 of lower container 304, and upper container 302 is attached or re-attached to lower container 304, package 300 contains milk in lower container 304 and dry cereal in upper container 302, with the milk and dry cereal being separated by valve 320, which has openings (apertures) that allow milk to flow between the two containers but that do not allow cereal pieces to pass from upper container 302 into lower container 304. To dispense a mixture of cereal and milk, a user tips package 300 to cause milk to flow from lower container 304, through upper container 302 and out of opening 311, which also causes cereal to flow from upper container 302 out of opening 311; the mixture of cereal and milk can be dispensed from opening 311, e.g., directly to a user's mouth. When package 300 is un-tipped back to vertical, much of any remaining milk present in interior space of upper container 302 drains into the lower container, with the exception of a small amount of milk that remains in reservoir 321.

See also FIGS. 6D through 6I, showing similar and other specific features of variations of package 300, using the same numbering.

Figure 7C:
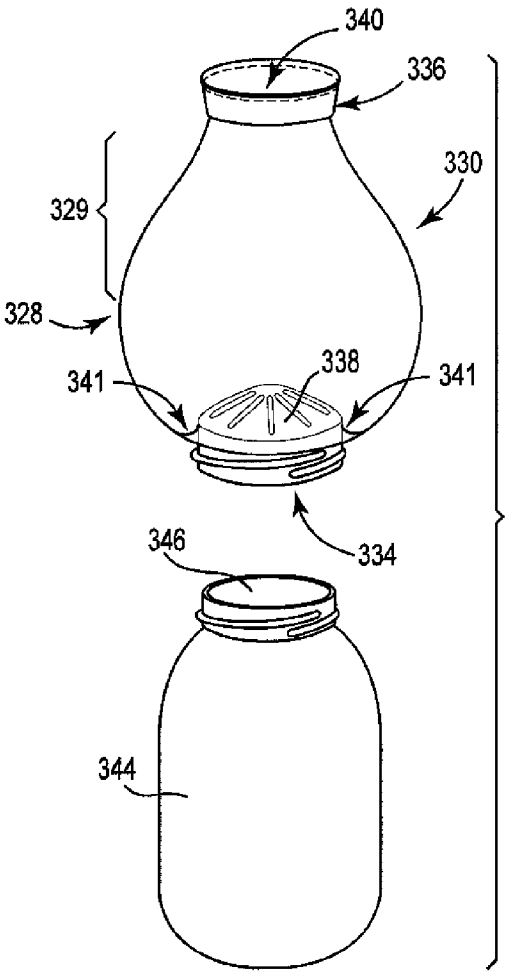
FIG. 7C is an exploded perspective view of package pieces as described.
Figure 7B:
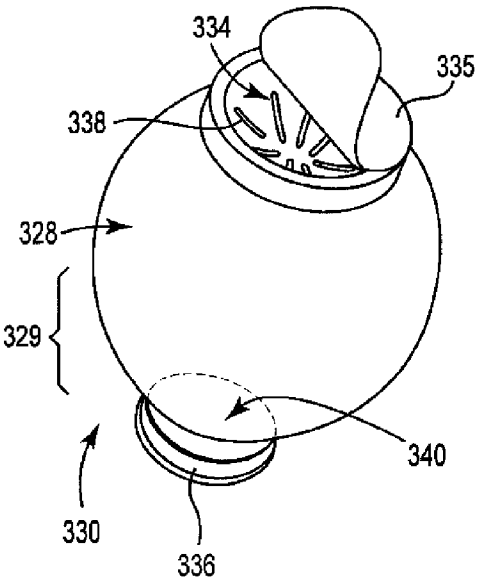
FIG. 7B is a bottom perspective side view a package or package piece as described.
Figure 7A:
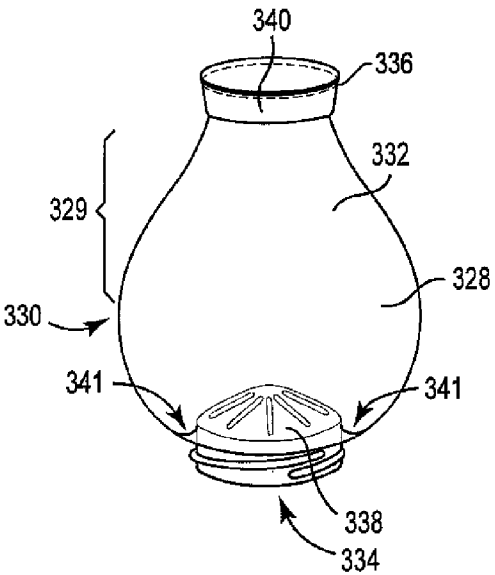
FIG. 7A is a perspective view of a package or package piece as described.

FIGS. 7A, 7B, and 7C illustrate a concept that involves the manufacture, marketing, packaging, and sale, of a cereal packaged without milk, but with the package being adapted to accept a milk container (e.g., chug) that could be purchased separately or in combination with the cereal package. As shown at these figures, the "cereal ball" package (330) is similar to the "upper" container of milk and cereal package 300 Package 330 includes upper and lower openings, a valve at the lower opening that allows flow of a liquid (milk) through the valve in either direction but does not allow cereal pieces to pass, and a reservoir at a bottom of the interior space below apertures of the valve. In use, a cover or "bottom seal" (335) (e.g., a paper or plastic film, a foil, etc., adhered by an adhesive) can be removed from the lower opening of the package and the lower opening can be engaged with a milk chug of a standardized size (e.g., diameter) and threading. A top cover (cover cap, 336) can be removed from the upper (cover) opening of the (upper) package and a mixture of milk and cereal can be delivered from the upper (cover) opening by tipping the package. Milk flows from the lower container, through the upper container and is delivered to a user's mouth in combination with cereal from the upper container. Milk that does not reach the upper opening will flow back through the valve into the lower container or be retained in the reservoir.

The cereal container generally includes sidewalls, a cover (shown to be embodied by a single continuous generally rounded or curved piece integral with the sidewalls), a cover opening in the cover, and a lower region that includes an engagement element for engaging a lower container in a liquid-tight manner; these features of an upper container can be one or multiple pieces, e.g., depending on how the upper container is manufactured.

Figure 8C:
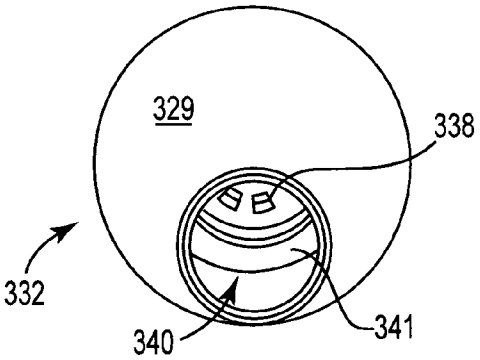
FIG. 8C is a top view of a package as described.
Figure 8D:
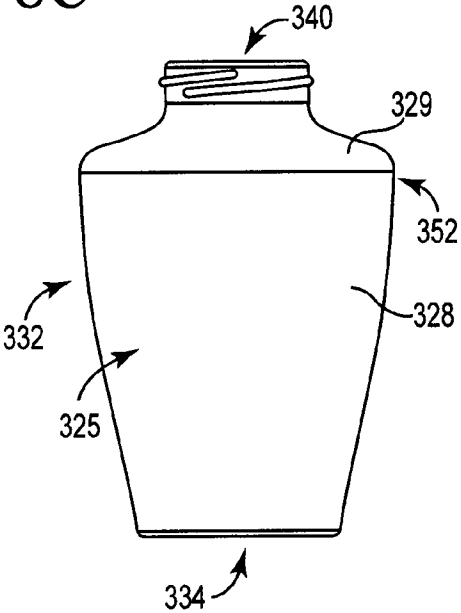
FIG. 8D is a side view of a package as described.
Figure 8B:
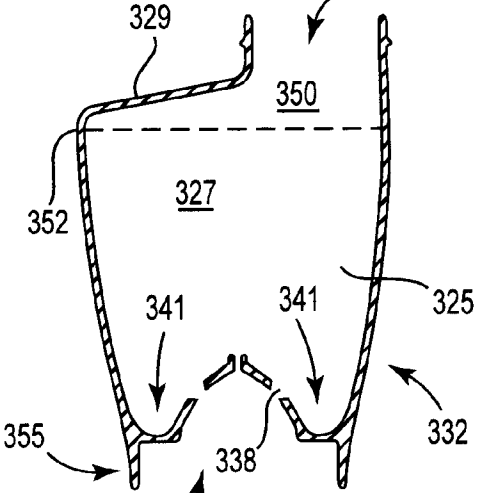
FIG. 8B is a side cut-away view of a package as described.
Figure 8A:
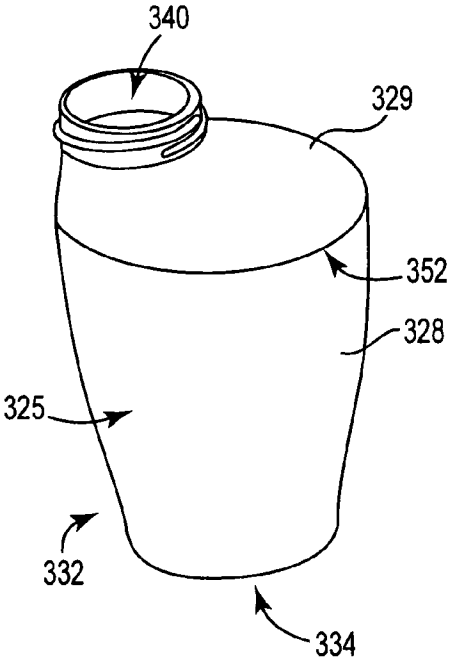
FIG. 8A is an upper perspective view of a package as described.
Figure 9C:
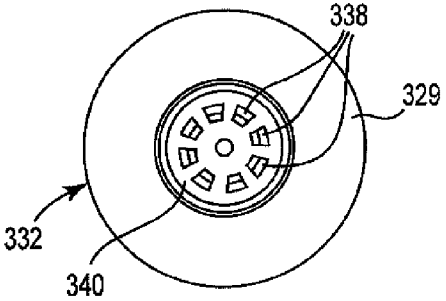
FIG. 9C is a top view of a package as described.
Figure 9D:
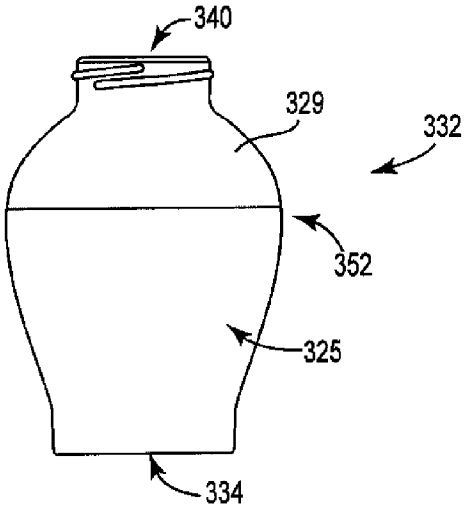
FIG. 9D is a side view of a package as described.
Figure 9A:
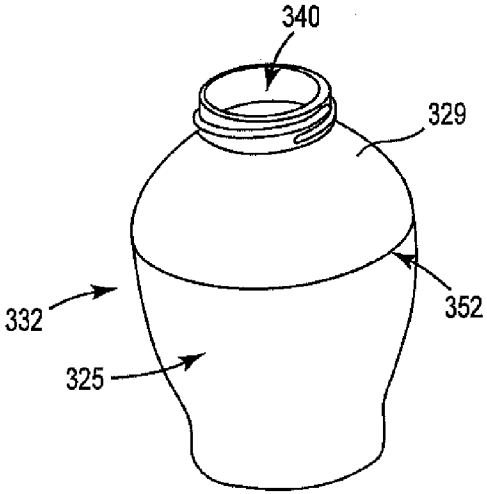
FIG. 9A is an upper perspective view of a package as described.
Figure 9B:
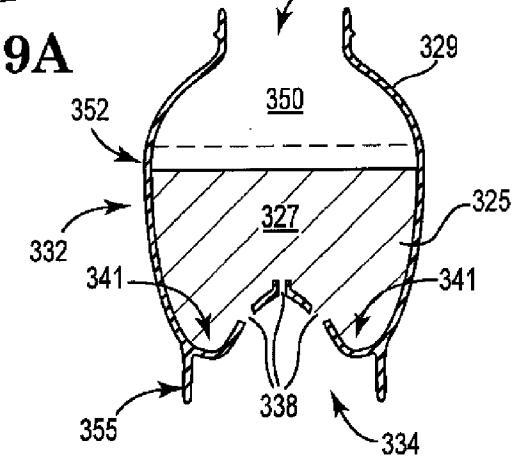
FIG. 9B is a side cut-away view of a package as described.
Figure 10C:
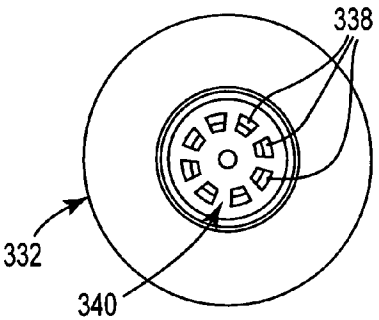
FIG. 10C is a top view of a package as described.
Figure 10D:
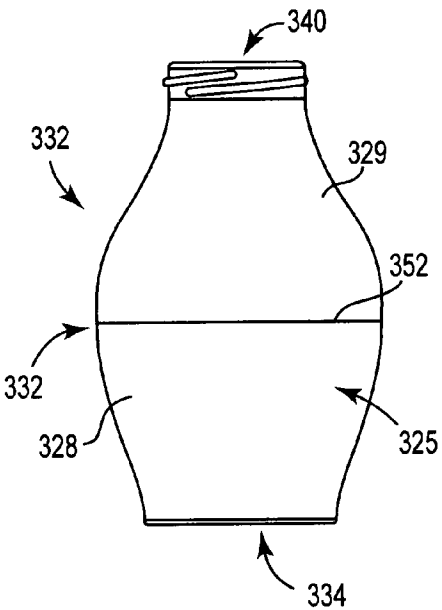
FIG. 10D is a side view of a package as described.
Figure 10B:
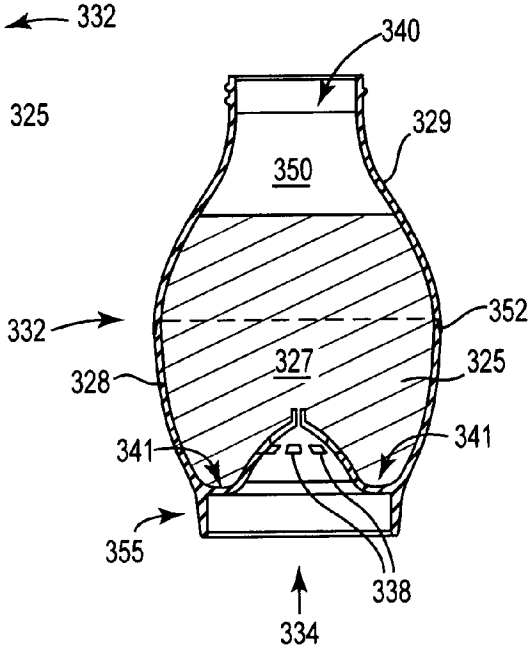
FIG. 10B is a side cut-away view of a package as described.
Figure 10A:
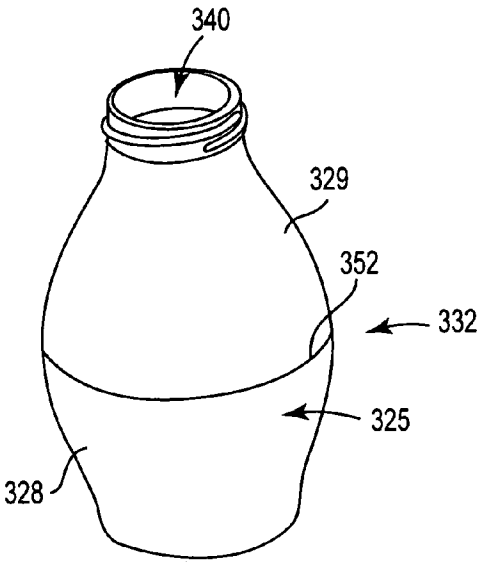
FIG. 10A is an upper perspective view of a package as described.

Referring to FIGS. 7A, 7B, and 7C, cereal package 330 includes cereal (or "upper") container 332 for containing dry cereal for storage, marketing, transport, and sale to a consumer (separately or in combination with a "lower" milk container). Container 332 includes upper opening 340, sidewalls 328, bottom opening 334, and is closed at upper opening 340 by cover cap 336 that covers upper (cover) opening 340. Container 332 can be considered to include an upper region (329) that is a "cover" located above an interior space of container 332. As illustrated the "cover" 329 and "sidewall" 328 regions are part of a single container piece 332, but in alternate embodiments these regions can be separate pieces (see, e.g., FIGS. 8A, 9A, and 10A). Cover cap 336 is secured to cereal container 332 around a rim at upper (cover) opening 340 by threads, and can be threaded and unthreaded (removed and replaced). Valve 338 is located within bottom opening 334 of container 332, and allows liquids (e.g., milk) to pass through in either direction, but does not allow cereal pieces to pass. Reservoir 341 retains a small amount of milk when container 322 is placed at vertical after being tipped to consume milk and cereal.

A lower container, 344, shown at FIG. 7C, can be attached to bottom opening 334, e.g., by threads. Lower container 304 can contain milk, which can be refrigerated or shelf stable, for storage, marketing, transport, and sale to a consumer. When attached, an engagement element (threads as illustrated) at an upper region of lower container 304, near opening 346 of lower container 344, engages an opposing engagement element (e.g., threads) at a lower region of upper container 332, near bottom opening 334, in a sealing, liquid-tight engagement. Container 332 is shaped to have convex sidewalls (328) and cover (329) to facilitate flow of cereal, milk, and wetted cereal, along sidewalls 328 without the wetted cereal sticking to the sidewalls. After cover cap 336 is removed to uncover (cover) opening 340 of container 332, lower container 344 contains milk, and upper container 332 contains dry cereal, the milk and cereal being separated by valve 338, which has openings that allow milk to flow between the two containers but that does not allow cereal pieces to pass from container 332 into container 344. To dispense a mixture of cereal and milk, a user tips the connected containers to cause milk to flow from (lower) container 344, through (upper) container 332 and out of opening 340, which also causes cereal to flow from container 332 out of (cover) opening 340; the mixture of cereal and milk can be dispensed from opening 340, e.g., directly to a user's mouth.

FIGS. 8A, 8B, 8C, and 8D show a variation of package 330, having varied shape features and a multi-piece configuration. For example, referring to FIG. 8A, cover opening 340 is located differently and sidewalls 328 and cover 329 are shaped differently relative to the variation at FIG. 7A. Also, at FIGS. 8A, 8B, 8C, and 8D, "upper" or "cereal" container 332 includes two pieces: cover piece 329 and upper container piece 325 comprising sidewalls 238. Upper container piece 325 defines upper container interior space 327, extending to perimeter (seam) 352 where a lower perimeter of cover piece 329 connects to an upper perimeter of upper container piece 325 in a liquid-tight manner. Cover piece 329 additionally defines coverspace 350 above perimeter 352. Each of cover piece 329 and upper container piece 325 can be manufactured by a desired method, such as by injection molding. At a lower region of upper container piece 325 is engagement element 355, shown generically to be any engagement element capable of engaging an upper region of a lower container (e.g., 344) in a liquid-tight manner.

FIGS. 9A, 9B, 9C, and 9D show a package with features similar to package 332 of FIGS. 8A, 8B, 8C, and 8D, with variations in shapes of upper container piece 325 and cover piece 329.

FIGS. 10A, 10B, 10C, and 10D also show a package with features similar to package 332 of FIGS. 8A, 8B, 8C, and 8D, with variations in shapes of upper container piece 325 and cover piece 329.

Any of the above package configurations can be used with any type of particulate food as a dry cereal. Dry cereals are well known and examples of useful cereals include any breakfast (a.k.a. "ready-to-eat" cereals) available as particulates, flakes, etc., produced from known food ingredients such as wheat grain, corn, rice, oats, barley, triticale, and the like, optionally including additional ingredients such as salt, minerals, protein, sugar fiber (e.g., bran, cellulose, pectin), vitamins, flavorants, colorants, etc.

The milk may be of the type generally stored at refrigerated temperatures, or at ambient (e.g., "shelf stable," "extended shelf life" or "ultra-pasteurized" milk) conditions.

The amounts of each of the cereal and milk contained in a combined cereal and milk package can be any amount, and in particular can be an amount suitable for a single serving for one individual, e.g., about ¾ cup (or about 6 ounces (volume) or about 177 cubic centimeters) (e.g., in a range from about ½ cup to 1 cup volume or from ⅔ cup to 1 cup volume) of cereal, and about 8 fluid ounces of milk (for example a volume of milk in the range of from about 4 ounces to about 12 ounces).

The materials of the package and containers thereof can be any packaging material currently available or designed in the future, including, for example, glass, paper, cardboard, and polymeric materials known for use in these applications. A glass or polymeric material may be see-through (transparent, clear, colored, shaded), opaque, translucent, colored, etc. Materials may be thermoplastic or thermoformed, or may be coated paper or cardboard, or combinations of these in multiple layers. Packages or pieces can be prepared by any method, such as by thermoforming or molding (e.g., injection molding). In preferred embodiments an internal sidewall surface can be made of or coated to exhibit a of a low surface energy, e.g., a surface energy below about 50 dynes per centimeter, or less than 40 or 38 dynes per centimeter. Exemplary low surface area materials include polystyrene, polyvinylalcohol (PVA) polyethylene, polypropylene, and the like.

Following are exemplary embodiments that are not intended to limit the foregoing description.

In one embodiment, a combined cereal and milk package includes a milk container ("lower container") that contains milk and a cereal container ("upper container") that contains dry cereal, including one or more of the following features:

- The milk container can be vented so that pressure within the container equalizes when milk is delivered,
- The cereal container can include a reservoir,
- The cereal container can include a three-dimensional cover or a three-dimensional cover piece,
- The cereal container can include a holding stage; upon tipping the package, milk and cereal can flow separately into a cereal holding stage near an opening at the top of the package, where the milk contacts the cereal and the milk and cereal can be delivered through the opening to a consumer,
- The milk container can be located in a position below the cereal container and a cereal container can contain a milk channel that leads milk from the milk container to the cereal holding stage,
- A cereal holding stage can include an upper end of the milk tunnel in the form of a milk port that is of a size to regulate the flow of milk from the milk tunnel into the cereal holding stage.

In another embodiment a combined milk and cereal container includes a milk container and a cereal container:

- The milk container can be on a bottom portion of the package and attached directly to the cereal container, located above the milk container,
- The top of the milk container may engage the bottom of the cereal container by any secure mechanical engagement, such as by a snap-fit engagement or a threaded engagement, e.g., a standardized threaded engagement,
- An opening of the milk container that engages the cereal container can optionally have a seal,
- The cereal container can include a second ("upper") opening through which a mixture of cereal and milk can be dispensed after milk and cereal are combined within the package, e.g., in the cereal container,
- An opening between the cereal container and the milk container can includes a "screen" (or "filter") that allows milk to flow from the milk container into the cereal container, or from the cereal container into the milk container, but does not allow cereal to pass from the cereal container to the milk container,
- The upper cereal container can also optionally include a reservoir,
- After unsealing the milk container, the cereal container can be attached or re-attached to the milk container,
- Milk and cereal can be delivered to a consumer from the upper opening at the top of the cereal container while the cereal container is engaged with the milk container,
- The cereal and milk containers may be packaged or sold together in combination, e.g., as a kit, or separately.

The invention claimed is:

1. A multi-container package comprising:

a lower container comprising:
- an upper region having an open top;
- a lower bottom;
- a lower sidewall;
- a lower interior space defined by the lower bottom and the lower sidewall, the lower interior space communicating with the opening;

an upper container connected to the upper region of the lower container, the upper container comprising:
- an upper sidewall having a lower region;

an upper bottom extending across a lower end of said upper sidewall, the upper bottom comprising:

an upwardly protruding valve comprising at least one aperture;

an annular channel surrounding the upwardly protruding valve, the annular channel having a downwardly protruding base extending between the lower region of the upper sidewall and the upwardly protruding valve, the annular channel defining a volume located below the at least one aperture;

an upper interior space defined by the upper bottom and the upper sidewall, the upper interior space being in fluid communication with the lower interior space and the volume of the channel is a portion of the upper interior space.

2. The multi-container package according to claim 1, wherein the volume of the annular channel ranges from 3 cubic centimeters to 30 cubic centimeters.

3. The multi-container package according to claim 1, the upper container further comprising a cover for the upper container.

4. The multi-container package according to claim 3, the cover further comprising: a cover body defining a cover interior below the cover body and above the upper interior space; and, a perimeter connected to the upper container.

5. The multi-container package according to claim 1, wherein the lower container is a first separate integral piece and the upper container is a second separate integral piece.

6. The multi-container package according to claim 5, further comprising:

the open top of the lower container further comprising a lower engagement portion;

the upper container further comprising:

an open top at an upper region of the sidewall;

an upper engagement portion at the upper bottom, the upper engagement portion fastened to the lower engagement portion of the lower container in a liquid-tight manner;

a cover having an outer portion engaging the open top in a liquid-tight manner.

7. The multi-container package according to claim 5, wherein the upper interior space does not extend into the lower interior space.

8. The multi-container package according to claim 5, the upper bottom further comprising: an extension sidewall extending from an outer perimeter of the upper sidewall toward the lower container, the extension sidewall comprising the upper engagement portion.

9. A package comprising:

a circumferential sidewall having:

an open top with an upper rim;

a lower rim;

an outer surface extending from the upper rim to the lower rim;

a first inner surface extending downwardly from the upper rim to a lower inner region of the sidewall;

a second inner surface extending upwardly from the lower rim to the lower interior region of the sidewall;

a cover fastened to the upper rim and having a cover opening;

a circular base extending inwardly from the lower inner region of the sidewall to separate the first inner surface from the second inner surface, the circular base substantially closing the lower inner region of the sidewall to define an upper cavity, and the circular base comprising:

a lower exterior surface having:

an annular protrusion;

a central concave portion;

wherein the second inner surface of the circumferential sidewall and the lower exterior surface of the circular base define a lower cavity;

an upper interior surface comprising:

a central convex portion having at least one aperture;

an annular channel surrounding the central convex portion and extending between the first interior surface of the circumferential sidewall and the central convex portion, the annular channel defining an interior annular volume ranging from 3 cubic centimeters to 30 cubic centimeters.

10. The package according to claim 9, wherein the interior annular volume ranges from 3 cubic centimeters to 30 cubic centimeters.

11. The package according to claim 9, wherein the interior annular volume ranges from 5 cubic centimeters to 20 cubic centimeters.

* * * * *